US008766756B2

(12) United States Patent
Hester et al.

(10) Patent No.: US 8,766,756 B2
(45) Date of Patent: Jul. 1, 2014

(54) TRANSVERSE SHROUD AND BOBBIN ASSEMBLY

(75) Inventors: Richard Laudale Hester, San Jose, CA (US); Jason Cuadra, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 34 days.

(21) Appl. No.: 13/103,447

(22) Filed: May 9, 2011

(65) Prior Publication Data

US 2012/0223799 A1 Sep. 6, 2012

Related U.S. Application Data

(63) Continuation-in-part of application No. 13/039,190, filed on Mar. 2, 2011, now abandoned.

(51) Int. Cl.
*H01F 27/02* (2006.01)

(52) U.S. Cl.
USPC ..... 336/90

(58) Field of Classification Search
USPC ..... 336/65, 90, 196, 198, 210
See application file for complete search history.

(56) References Cited

U.S. PATENT DOCUMENTS 3,750,073 A * 7/1973 Okano ..... 336/198
3,909,761 A * 9/1975 Miles ..... 336/192
4,000,483 A * 12/1976 Cook et al. ..... 336/98
4,363,014 A * 12/1982 Leach et al. ..... 336/90
4,405,913 A * 9/1983 Finkbeiner ..... 336/98
4,510,478 A * 4/1985 Finkbeiner ..... 336/198
4,719,394 A * 1/1988 Watanuki ..... 315/408
5,153,550 A * 10/1992 Sugiura et al. ..... 336/192
5,696,477 A * 12/1997 Yamamori et al. ..... 336/192
5,783,982 A * 7/1998 Lecheler ..... 336/192
6,992,558 B1 * 1/2006 Vallen ..... 336/209

FOREIGN PATENT DOCUMENTS

JP 10289829 A * 10/1998

* cited by examiner

*Primary Examiner* — Tuyen Nguyen
(74) *Attorney, Agent, or Firm* — Blakely Sokoloff Taylor & Zafman LLP

(57) ABSTRACT

A transformer assembly includes a vertical bobbin and a shrouding element. The vertical bobbin includes a first winding portion, a second winding portion, and a flange. The flange is disposed between the first winding portion and the second winding portion. The flange includes a flange edge. The shrouding element, which substantially covers the first winding portion or the second winding portion, includes a shrouding edge that is operatively coupled to the flange edge. The flange edge and the shrouding edge have at least one complementary corrugation. In one example, the flange edge includes at least one groove and the shrouding edge includes at least one protrusion that is complementary to the groove. In another example, the shrouding edge includes at least one groove and the flange edge includes at least one protrusion that is complementary to the groove.

20 Claims, 18 Drawing Sheets

TRANSVERSE SHROUD AND BOBBIN ASSEMBLY

RELATED CO-PENDING APPLICATIONS

This application is a continuation-in-part of co-pending U.S. patent application Ser. No. 13/039,190, filed Mar. 2, 2011, entitled Shroud for Bobbin, having as inventor Richard Laudale Hester, owned by instant assignee and incorporated in its entirety herein by reference.

FIELD

This disclosure relates generally to electronic components, and more specifically to protective coverings for electronic components.

BACKGROUND

Switched mode power converters are typically constructed by mounting electronic components onto a printed circuit board (PCB). One electrical component typically included in a switched mode power converter is a transformer, which is one example of an energy transfer element. During operation the transformer allows the transfer of energy between an input side (referred to as a primary side) of the power converter and an output side (referred to as the secondary side) of the power converter. The input and output sides of the transformer are typically galvanically isolated from each other. Galvanic isolation occurs when dc current is unable to flow between the input side and output side of the power converter.

Transformers typically include coils of wire wound around a structure called a bobbin. The bobbin provides support for the coils of wire and also provides an area for a core of magnetically active material (such as ferrite or steel) to be inserted so that the coils of wire can encircle the core. The coils of wire make up the primary and secondary windings of the transformer. The core provides a path for a magnetic field generated by an electric current flowing through the coils of wire. The area around the bobbin where coils of wire can be wound is often referred to as the bobbin window.

Safety regulations require a minimum amount of creepage distance and clearance distance between the coils of wire of the primary, coils of wire of the secondary, and the core. Creepage distance is the length of the shortest path between two conductive parts along the surface of the structure separating them. Clearance distance is the shortest distance through the air between two conductive parts. To meet creepage and clearance distances, a designer may have to sacrifice usage of the bobbin window. In other words, some applications are unable to utilize the entire bobbin window while meeting creepage and clearance distances. For applications that utilize the entire bobbin window, the design of the bobbin (and the overall transformer) can be bulky, which is undesirable. Design of a bobbin is typically a compromise between copper loss, core loss, size and the safety considerations of creepage distance, clearance distance, and insulation requirements.

BRIEF DESCRIPTION OF THE DRAWINGS

The present disclosure is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1A:
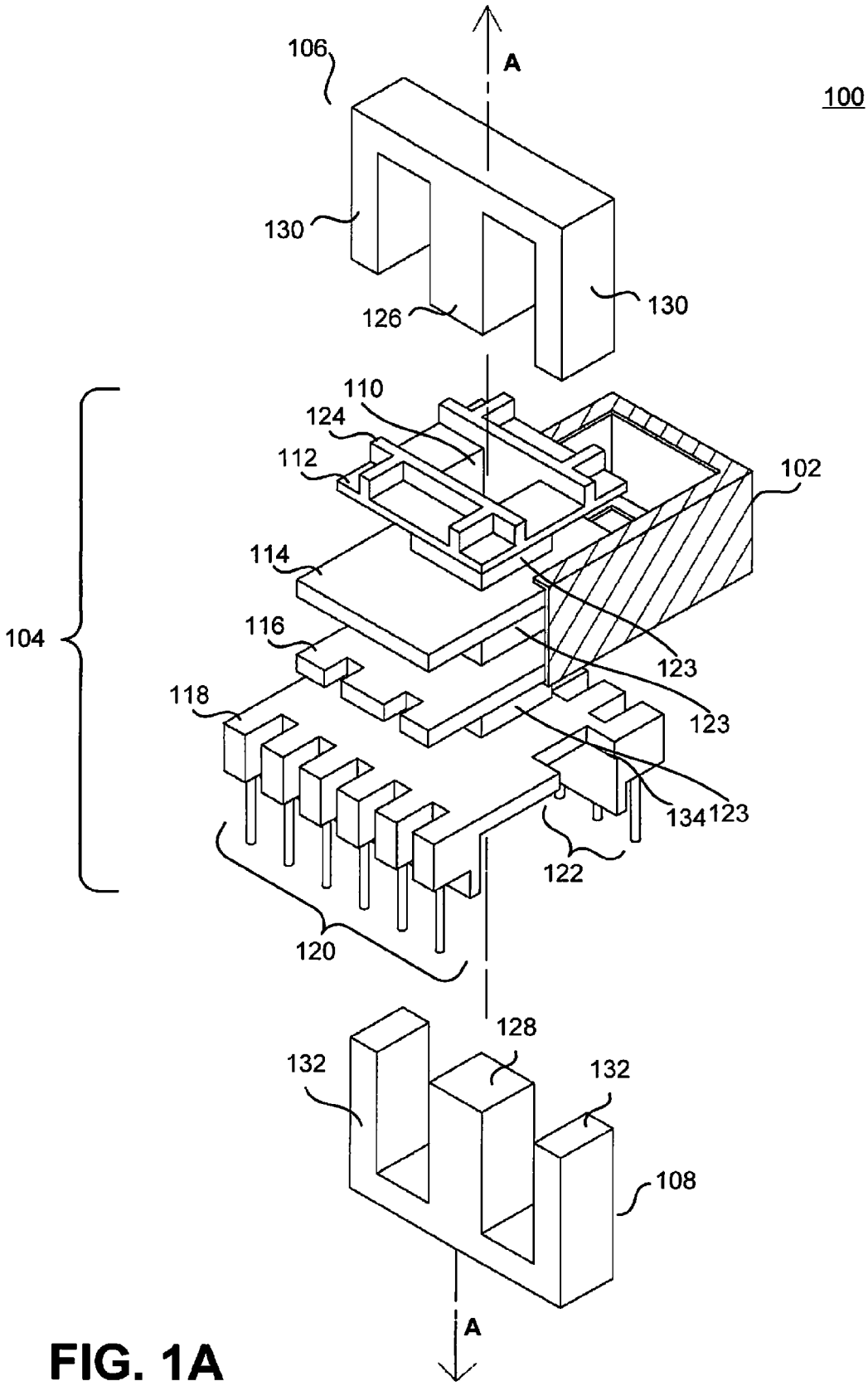
FIG. 1A is an example exploded view illustrating a transformer utilizing a shroud according to the present disclosure.

Embodiments of a shroud for a vertical bobbin are described herein. In the following description numerous specific details are set forth to provide a thorough understanding of the embodiments. One skilled in the art will recognize, however, that the techniques described herein can be practiced without one or more of the specific details, or with other methods, components, materials, etc. In other instances, wellknown structures, materials, or operations may not be shown or described in detail to avoid obscuring certain aspects.

Reference throughout this specification to "one embodiment," "an embodiment," "one example," or "an example" means that a particular feature, structure or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures or characteristics may be combined in any suitable combinations and/or subcombinations in one or more embodiments or examples. In addition, it is appreciated that the figures provided herewith are for explanation purposes to persons ordinarily skilled in the art and that the drawings are not necessarily drawn to scale. Furthermore, unless stated otherwise, terms such as "first" and "second" are used to arbitrarily distinguish between the elements such terms describe. Thus, these terms are not necessarily intended to indicate temporal or other prioritization of such elements.

Switching power supplies are typically constructed by mounting electronic components onto a printed circuit board (PCB). One electrical component often included in a power supply is a transformer, which is one example of an energy transfer element. The construction of a transformer may include winding coils of wire (which make up the primary and secondary winding) around a structure called a bobbin. The bobbin provides support for the coils of wire and may also provide an area for a core of magnetically active material (such as ferrite or steel) to be inserted such that the coils of wire encircle the core. The core defines a path for a magnetic field generated by an electric current flowing through the coils of wire. The wire utilized is typically made from copper. The area around the bobbin where coils of wire may be wound is often referred to as the bobbin window.

Safety regulations require a minimum amount of creepage distance and clearance distance between the coils of wire of the primary, coils of wire of the secondary, and the core. Typically, the creepage distance is the length of the shortest path between two conductive parts along the surface of the structure separating them. Clearance distance is the shortest distance through the air between two conductive parts. To meet creepage and clearance distances, a designer may have to sacrifice usage of the bobbin window. In other words, some applications are unable to utilize the entire bobbin window while meeting creepage and clearance distances. Design of a transformer is typically a compromise between copper loss, core loss, size and the safety considerations of creepage distance, clearance distance, and insulation requirements.

Transformer design becomes more complicated when designing a transformer for a resonant power converter. One example of a resonant power converter is an LLC converter, which utilizes two inductors and one capacitor to create a resonant network for the power converter. Transformer designs may be more complicated for LLC converters due to the added constraint that the transformer utilized for an LLC converter requires a controlled amount of leakage inductance. The leakage inductance is partially a function of the bobbin window fill factor (the amount of the bobbin window which is utilized), the number of turns of the coils of wire, and the coupling between windings. In many cases, the bobbin window fill factor is sufficiently high that it is difficult to meet creepage distance and clearance distance requirements without adding additional insulation (which adds to the overall size of the transformer) between the core, primary winding (s), and secondary winding(s).

Previous solutions have included a snap-on cover that encapsulated an entire horizontal bobbin including coils of wire wound around the horizontal bobbin. The snap-on cover insulates and protects the coils of wire (both the primary and secondary windings) from the core. However, these solutions can result in a loss in the usage of the bobbin window along with creating a large, bulky transformer. In addition, previous solutions are utilized for horizontal bobbins (i.e., a bobbin that has electrical terminals on distal ends of its center axis and where its center axis is designed to lie parallel to the PCB).

Embodiments of the present disclosure include a shroud that partially covers the bobbin to protect the one of the windings from the core. In addition, the shroud allows for creepage and clearance distances to be met while allowing for the entire bobbin window to be utilized. In other words, the disclosed shroud preserves the bobbin window while reducing the size of the bobbin used. As such, the disclosed shroud allows for a compact transformer structure, which can reduce size and cost of the overall power converter.

In one example, a shroud includes a shrouding element and a window. The shrouding element is adapted to substantially cover either a first winding portion or a second winding portion of a vertical bobbin. The window, which is formed in the shrouding element, allows access to the first winding portion or the second winding portion (whichever is substantially covered by the shrouding element) through the shrouding element. The vertical bobbin has electrical terminals on a single end of its center axis and its center axis is designed to lie perpendicular to the PCB.

Figure 1B:
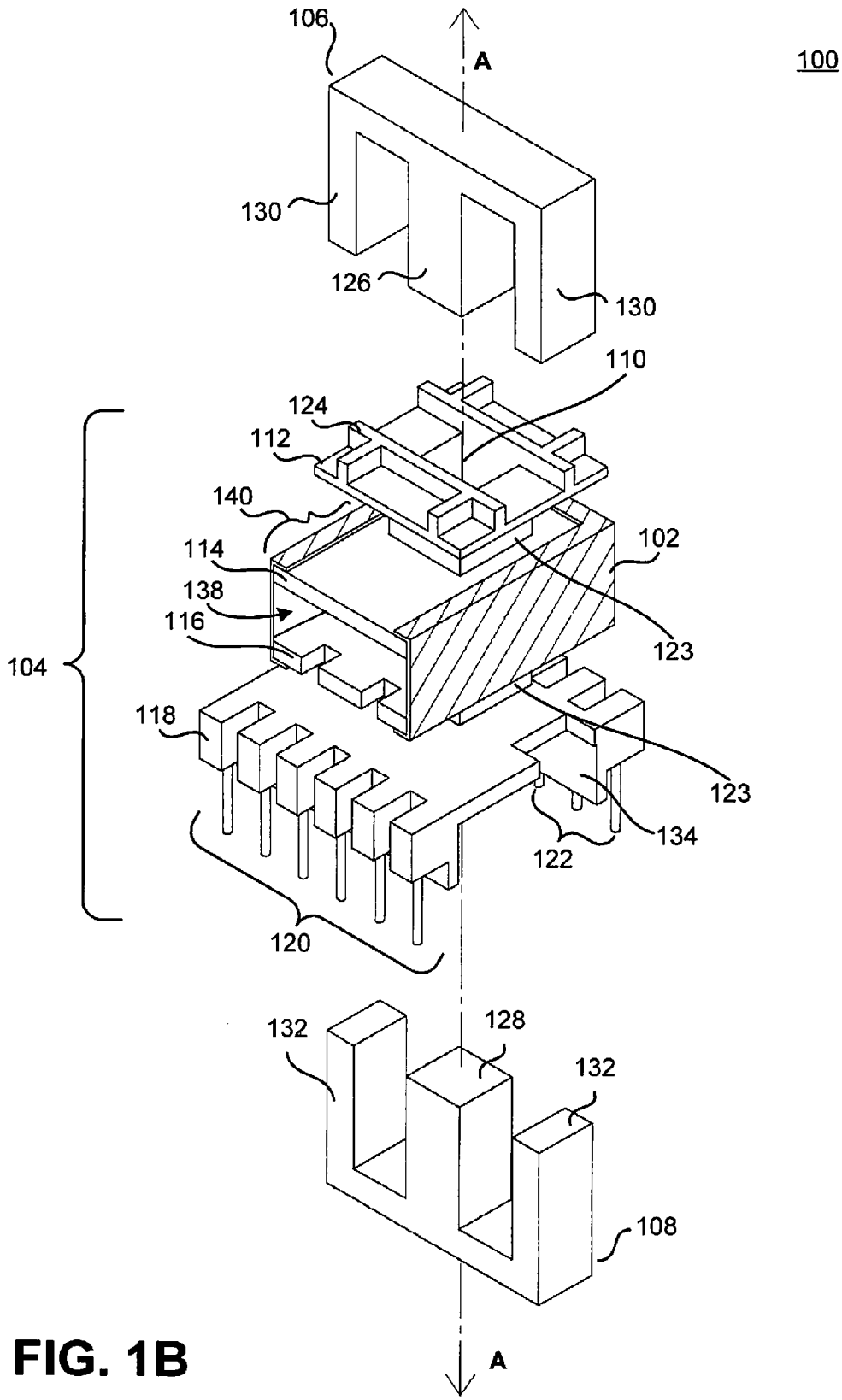
FIG. 1B is an example exploded view further illustrating the transformer of FIG. 1A.

Referring now to FIGS. 1A and 1B, example exploded views of a transformer 100 are depicted. The transformer 100 includes a shroud 102, a bobbin 104, a top core section 106, and a bottom core section 108. The bobbin 104 includes an opening 110, an upper flange 112, a middle flange 114, a lower flange 116, a base flange 118, a first set of terminals 120, a second set of terminals 122, and a spool 123. The upper flange 112 includes core guides 124. The top core section 106 includes a top inner core section 126 and top outer core sections 130. Likewise, the bottom core section 108 includes a bottom inner core section 128 and bottom outer core sections 132. As shown in this example, the top core section 106 and the bottom core section 108 are e-cores made of magnetically active material such as ferrite, steel, or other suitable magnetically active material. However, it is appreciated that other suitable cores and/or bobbin shapes can be used in accordance with the present disclosure. FIG. 1A illustrates shroud 102 partially attached to bobbin 104 and FIG. 1B illustrates the shroud 102 attached to bobbin 104.

As shown, the terminals 120 and 122 are mounted to the base flange 118. In one example, the terminals 120, 122 can be through-hole mount or surface mount terminals and can include a conductive material, such as metal and/or other suitable conductive material. The base flange 118 can be made from an insulating material such as plastic and/or other suitable insulating material. In one embodiment, the terminals 120, 122 can be molded directly onto lower surface of base flange 118 if desired. As shown in FIGS. 1A and 1B, the terminals 120, 122 are mounted on opposite ends of base flange 118. Although FIGS. 1A and 1B show 9 terminals, any number of terminals can be utilized.

The spool 123 is configured to have a coil wire arrangement wound around its circumference. In one example, the coil wire arrangement can include a primary winding and a secondary winding of a transformer. In another example, the coil wire arrangement can include any number of primary windings, secondary windings, and/or other windings (such as a bias winding for example). In one example, the coil wire arrangement can be wound directly onto spool 123. As shown, in this example, there are three sections (e.g., a top section, a middle section, and a lower section) that coil wire arrangements can be wrapped around the spool 123. Coil wire arrangements can be wound between upper flange 112 and middle flange 114 (e.g., top section of bobbin 104), between middle flange 114 and lower flange 116 (e.g., middle section of bobbin 104), and between lower flange 116 and base flange 118 (e.g., lower section of bobbin 104).

In one embodiment, coil wire arrangements wound in the top section and the lower section can be primary windings and the coil wire arrangement wound in the middle section can be secondary windings of transformer 100. The coils of wire wrapped in the top section and lower section of bobbin 104 can terminate at any of terminals 122. The coils of wire wrapped in the middle section of bobbin 104 can terminate at any of terminals 120. The bobbin 104 can then be mounted on a printed circuit board (PCB) (not shown). In another embodiment, the coil wire arrangements can terminate directly onto a PCB. In one example, the primary windings are wrapped in the top section and lower section of bobbin 104 and the secondary winding is wrapped in the middle section of bobbin 104. The side of bobbin 104 with terminals 120 may be referred to as the secondary side, while the side of bobbin 104 with terminals 122 may be referred to as the primary side.

As shown in FIGS. 1A and 1B, the vertical bobbin 104 includes the opening 110 that extends through the upper flange 112, middle flange 114, lower flange 116, base flange 118, and spool 123. The opening 110 is configured to receive the top inner core section 126 and the bottom inner core section 128 along axis A. In one example, the opening 110 and the spool 123 have a rectangular cross section, however, cross sections of other shapes are contemplated. In another example, the opening 110 and spool 123 have a square cross section.

The upper flange 112 includes core guides 124. The core guides 124 are configured to align the top core section 106 with the upper flange 112. Similarly, the base flange 116 includes core guides 134 configured to align the bottom core section 108 with the base flange 118. The top core section 106 and the bottom core section 108 can be coupled together in any suitable manner to enclose the vertical bobbin 104 and shroud 102. In one example, the top core section 106 and the bottom core section 108 are coupled together using an adhesive such as glue, tape, and/or other suitable adhesive. In one example, the top core section 106 and the bottom core section 108 can include a magnetically active core material, such as iron-ferrite or other suitable magnetic core material. In another example, the top core section 106 and bottom core section 108 can include an air gap or a non-magnetically active core material, or both. In a further example, the air gap or non-magnetically active core material may be utilized to alter the effective permeability of the core.

As shown, the shroud 102 substantially covers (and protects) coils of wire wrapped in the middle section of bobbin 104. As will be further discussed, the shroud 102 includes a lip along its top and bottom, which allows the shroud 102 to slide and align onto the middle flange 114 and the lower flange 116. As shown in FIG. 1A, the shroud 102 is partially affixed to the bobbin 104. As shown in FIG. 1B, the shroud 102 is completely affixed to the bobbin 104.

The shroud 102 includes a window 138 (specifically shown in FIG. 1B) on the same side as terminals 120, which allows access to the wires wrapped in the middle section of bobbin 104. As such, the coil wire arrangement wrapped in the middle section of bobbin 104 may terminate at terminals 120 or the PCB. In one example, the shroud 102 is made of an insulating material thick enough to meet minimum requirements for reinforced insulation between windings and the cores 106, 108. In one example, the insulating material can comprise plastic, insulating tape, and/or any other suitable insulating material. In one example, the insulating material is approximately four tenths of a millimeter (mm) thick although other thicknesses are contemplated. In another example, the shroud 102 is made of multiple layers of insulating material (such as insulating tape) that meet insulation requirements. When utilizing multiple layers of insulating material, at least two layers of insulating material should meet safety voltage withstand regulations. In one embodiment, the shroud 102 may be made with three layers of insulating material.

As shown, the shape of the shroud 102 is similar to the shape of the vertical bobbin 104 and thus contours the vertical bobbin 104. As such, the vertical cross section of shroud 102 outlines the vertical cross section of the middle flange 114 and lower flange 116.

In this example, the shroud 102 partially covers on the vertical bobbin 104 (i.e., the shroud 102 covers the coil wire arrangement wrapped in the middle section of bobbin 104). Accordingly, in this example, the shroud 102 insulates wires wrapped within the shroud 102 from the top core section 106 and the bottom core section 108. In addition, the shroud 102 includes an extended creepage section 140 (specifically shown in FIG. 1B and will be further discussed with respect to FIG. 3) to ensure that minimum creepage and clearance distances are met between wires in the middle section of bobbin 104 and wires wrapped in both the top section of bobbin 104 and the lower section of bobbin 104. The middle flange 114 and the lower flange 116 also extend to the approximate same length of the shroud 102 to ensure that creepage and clearance distances are met. Additionally, the shroud 102 allows for minimum creepage and clearance distances to be met between wires wrapped in the middle section of bobbin 104 and top core section 106 and bottom core section 108.

In one example, the primary windings are wrapped in the top section and lower section of bobbin 104 and the secondary winding is wrapped in the middle section of bobbin 104. The side of bobbin 104 with terminals 120 may be referred to as the secondary side while the side of bobbin 104 with terminals 122 may be referred to as the primary side. In this example, the shroud 102 allows for minimum creepage and clearance distances to be met between the secondary winding and the primary windings. Minimum creepage and clearance distances between the secondary winding and the top core section 106 and bottom core section 108 are also met. Creepage and clearance distances are further discussed with reference to FIG. 3.

Figure 2:
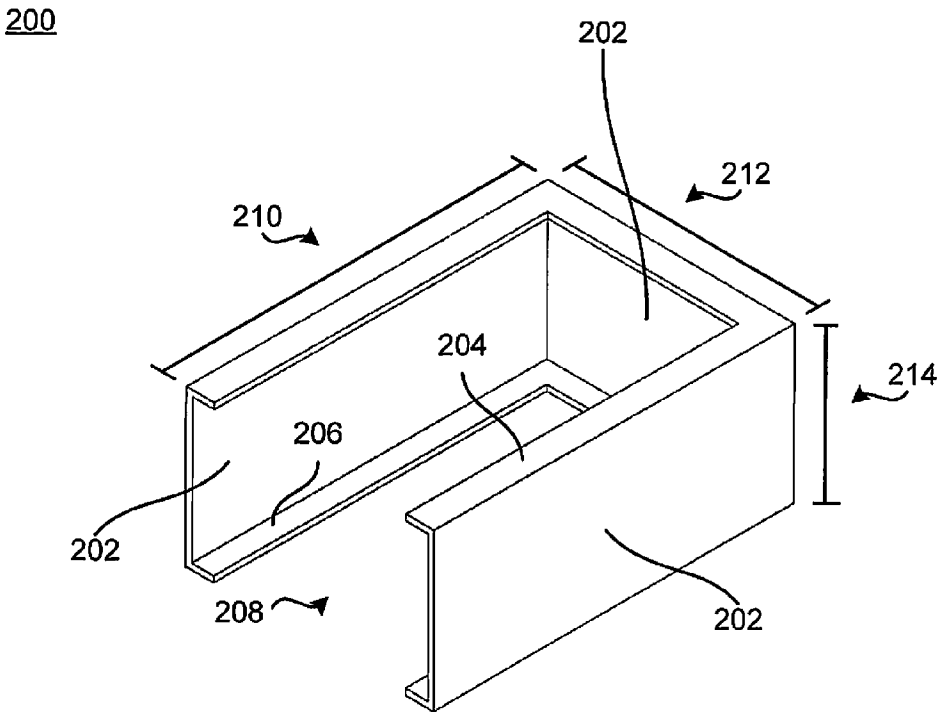
FIG. 2 is an example perspective view illustrating a shroud of FIGS. 1A and 1B.

Referring now to FIG. 2, an example perspective view of a shroud 200 is depicted. The shroud 200, which is one example of shroud 102, includes a shrouding element 202, an upper attachment lip 204, a lower attachment lip 206 and a window 208. The length, width, and height of the shroud 200 are denoted by reference numbers 210, 212, and 214, respectively.

As shown, the length 210 and width 212 of the shroud 200 is substantially equal to the length and width 210 of both the middle flange 114 and lower flange 116. The shrouding element 202 substantially covers the middle section of bobbin 104. The height of the shrouding element 202 (and shroud 200) is substantially equal to the height between the upper surface of middle flange 114 and the lower surface of lower flange 116. In the example shown, the shrouding element 202 contours the shape of the vertical bobbin 104, in particular the outline of the middle flange 114 and lower flange 116. As such, the shrouding element 202 has a shape sustainably similar to the vertical bobbin 104. Those of ordinary skill in the art will appreciate that the shrouding element 202 can be of any shape, but is partially determined by the shape of the vertical bobbin 104.

The upper attachment lip 204 and the lower attachment lip 206 align the shroud 200 with the middle flange 114 and lower flange 116. The upper attachment lip 204 and the lower attachment lip 206 further attaches the shroud 200 to bobbin 104. In one embodiment, the width of the upper attachment lip 204 and lower attachment lip 206 (e.g., the distance which the both attachment lips extend from the shrouding element 202) is based on a predetermined creepage distance that meets (or exceeds) creepage distance requirements. For example, in one embodiment the width of the upper attachment lip 204 and lower attachment lip 206 can be sized to provide an overall creepage distance (between conductive elements of the transformer) of approximately 6 millimeters (mm). Although an overall creepage of approximately 6 mm is used in this example, other overall creepage distances are contemplated. In one example, the height and width of the window 208 is substantially equal to height 214 and width 212. As noted above, the window 208 (e.g., window 138) allows access to coils of wire wound around the vertical bobbin such that the coils of wire may terminate to terminals of the vertical bobbin or the PCB.

In one example, the shroud 200 is made of any suitable insulating material (e.g., plastic, insulating tape, etc.) that has a thickness based on a predetermined insulation thickness that meets (or exceeds) minimum requirements for reinforced insulation between a winding and the core 106 and 108. In one example, the shroud 200 is at least 0.4 mm thick. In another example, the shroud 200 is made of multiple layers of insulating material, such as insulating tape for example. When utilizing multiple layers of insulating material, at least two layers of insulating material is used to meet safety voltage withstand regulations. In one embodiment, the shroud 200 can comprise three layers of insulating material (e.g., insulating tape).

Figure 3:
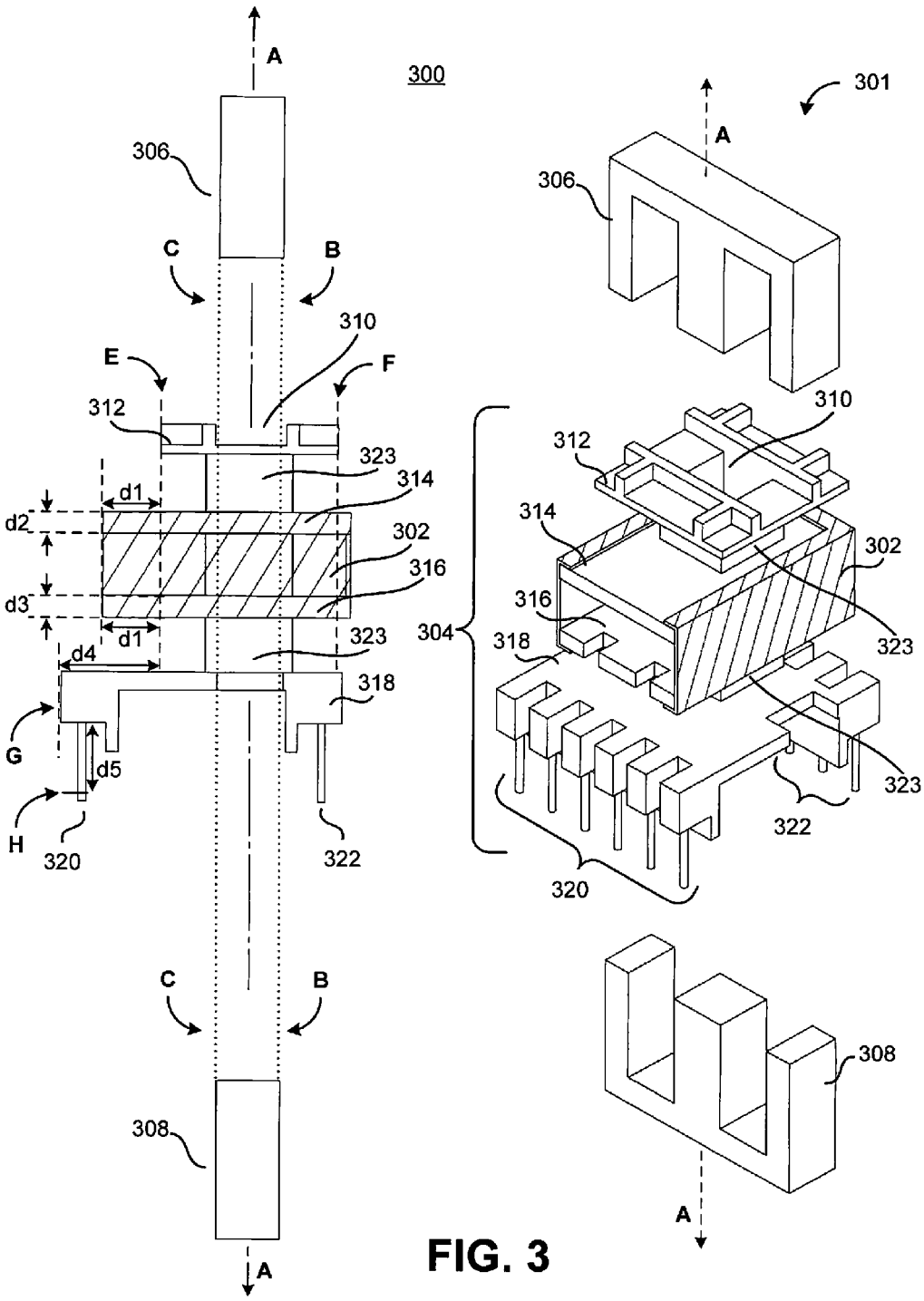
FIG. 3 is an example side view illustrating an exploded view of the transformer and shroud of FIGS. 1A and 1B.

Referring now to FIG. 3, an example side view is illustrated alongside of an exploded view 301 of the transformer 300. Transformer 300 is one example of transformer 100 discussed with reference to FIGS. 1A and 1B. The exploded view 301 correlates to corresponding elements in the side view of the previously described transformer 100. As shown, exploded view 301 is similar to FIGS. 1A and 1B. The transformer 300 includes a shroud 302 (illustrated with hatch lines), a vertical bobbin 304, a top core section 306, and a bottom core section 308. The vertical bobbin 304 further includes an opening 310, an upper flange 312, a middle flange 314, a lower flange 316, a base flange 318, terminals 320, and terminals 322, and spool 323. Further illustrated in FIG. 3 are lines C, B, E and F, surface G, point H and distances d1, d2, d3, d4, and d5.

Similarly named and numbered elements in FIG. 3 correlate with elements of FIGS. 1A, 1B and 2. In the example shown in FIG. 3, lines C and B denote where the top core section 306 and the bottom core section 308 fit into the vertical bobbin 304. Lines E and F denote the area where coils of wire can be wound around the vertical bobbin 304. In other words, coils of wire can be wound around spool 323 between lines E and F in the top section (between upper flange 312 and middle flange 314), the middle section (between middle flange 314 and lower flange 316) and the lower section (between lower flange 316 and base flange 318) of bobbin 304. The smallest area around the bobbin where coils of wire may be wound is often referred to as the bobbin window. The bobbin window may be the distance between line E and one end of spool 323 or the distance between line F and the other end of spool 323 or the distance between the spool 323 and both the upper core section 306 and bottom core section 308, whichever is smallest.

As shown, the middle flange 314 and the lower flange 316 extend past the upper flange 312 by distance d1. Distance d1 can also be referred to as the extended creepage distance (extended creepage distance 140 of FIGS. 1A and 1B). As noted above, the shroud 302 is of sufficient thickness to insulate the windings from the core (or when utilizing multiple layers of insulating material, two or more layers meet safety voltage withstand regulations). In addition, the shroud 302 extends by the extended creepage distance d1 to allow creepage distances to be met while preserving bobbin window space. As illustrated in FIG. 3, the core 302 is hatched and transparent to illustrate the distance between the spool 323 and lines E and F in the middle section of bobbin 304.

When coils of wire are wound so that wire fills the vertical bobbin from line E to F for all three bobbin sections (corresponding to full usage of the bobbin window or maximum bobbin window fill factor), the minimum creepage between the wires filling the middle section and the wires filling the upper section would be the sum of distance d1 (the length along the upper surface of middle flange 314), distance d2 (the width of middle flange 314), and distance d1 again (the length along the lower surface of middle flange 314). In addition, the minimum creepage between wires filling the middle section and wires filling the lower section are the sum of distance d1 (the length along the upper surface of lower flange 316), distance d3 (the width of lower flange 316), and the distance d1 again (the length along the lower surface of lower flange 316). For the example, when the primary windings are wrapped in the top section and the lower section and the secondary winding is wrapped in the middle section, the creepage distance between the primary winding in the top section and the secondary winding is at least 2d1+d2. The creepage distance between the lower primary winding in the lower section and the secondary winding is at least 2d1+d3. As mentioned above, distance d1 is also referred to as the extended creepage distance 140. By having an extended creepage distance 140, d1, creepage between the wires wrapped in the middle section and the wires wrapped in both the top section and the bottom section may be increased.

As noted above, wire wrapped around the spool 323 in the middle section (between middle flange 314 and lower flange 316) of bobbin 304 exits the middle section and may terminate at one or more of the terminals 320 or the PCB. Additionally, there is a creepage distance of at least distance d4 between the wire exiting the middle section and the coils of wire wrapped around spool 323 in the lower section (between lower flange 316 and base flange 318). Depending on how tightly the wire is wound around the terminal 320, there can also be an additional creepage distance along surface G. In the example shown, wire wrapped around spool 323 in the middle section (e.g., the secondary winding) terminates at point H of terminal 320. The creepage distance between the wire (e.g., the secondary winding) and the bottom core section 312 is approximately the sum of distance d5 and the distance along the entire lower surface of base flange 318 from the pin 320 to line C. In general, skilled artisans are mostly concerned with the total creepage distance for safety regulation. For example, the sum of all the creepage distances between the primary winding and the secondary winding can be greater than the minimum required creepage distance for safety regulations.

The same is true for creepage distances between either the primary winding or secondary winding and the core of the transformer.

Figure 4:
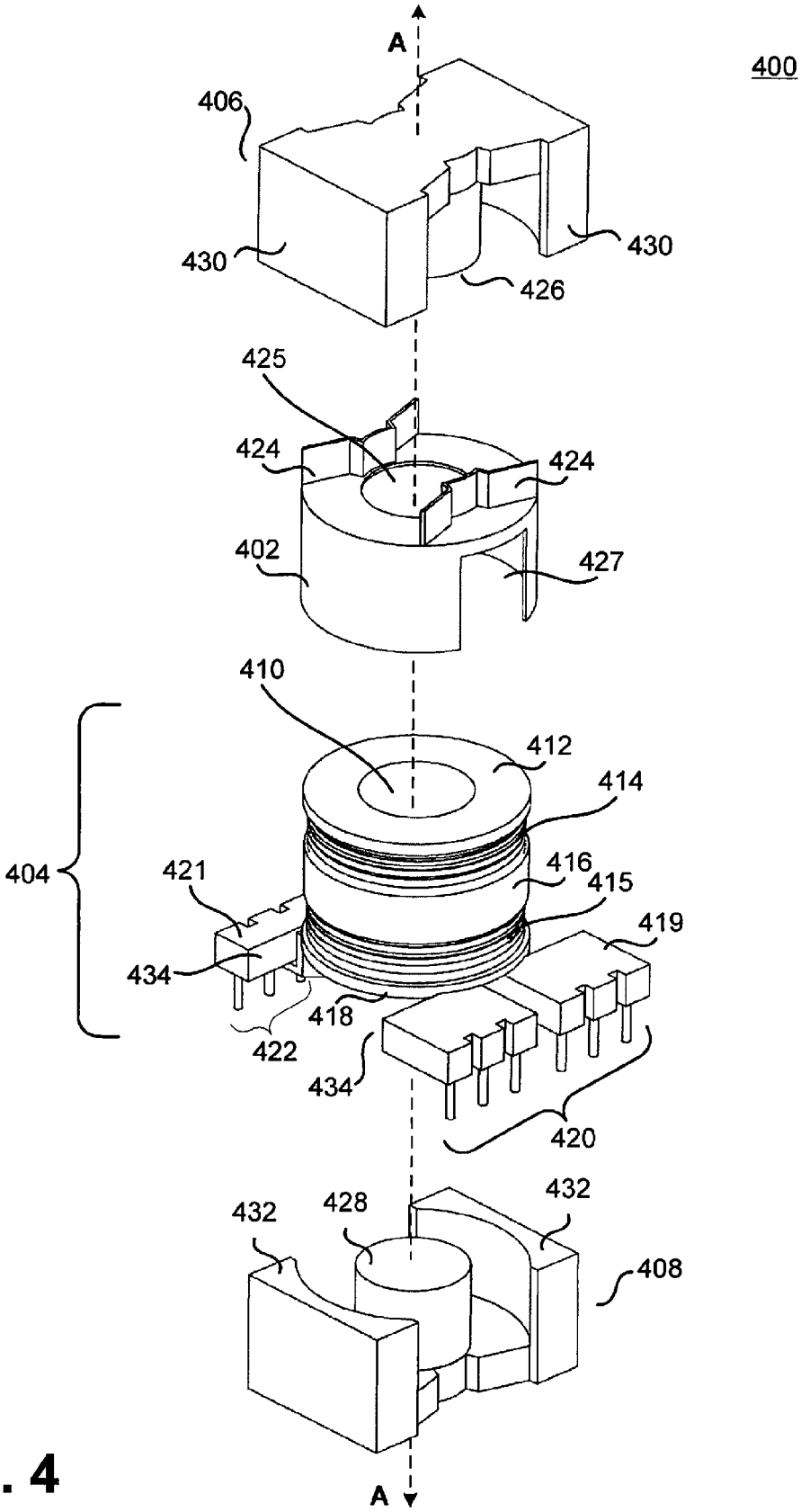
FIG. 4 is an example exploded view illustrating another transformer utilizing a shroud according to the present disclosure.

Referring now to FIG. 4, an example exploded view of another transformer 400 is illustrated including a shroud 402, a vertical bobbin 404, a top core section 406, and a bottom core section 408. The vertical bobbin 404 further includes an opening 410, an upper flange 412, a barrier 416, a primary coil wire arrangement 414, a secondary coil wire arrangement 415, a base flange 418, terminal base members 419 and 421, terminals 420 and 422, and spool (not shown). As depicted in FIG. 4, the top core section 106 and the bottom core section 108 are examples of PQ cores. However, it is appreciated that many different cores and bobbin shapes can be utilized with accordance with the present disclosure. In addition, the top core section 406 and bottom core section 408 include inner core sections 426 and 428, respectively, and outer core sections 430 and 432, respectively.

As shown in FIG. 4, terminals 420 and 422 are mounted to terminal base members 419 and 421, respectively. In one example, terminals 420 and 422 can be through mount terminals or surface mount terminals and can include a conductive material, such as metal and/or other suitable conductive material. Terminal base members 419 and 421 can be made from an insulating material such as plastic and/or other suitable insulating material. In one example, the terminals 420, 422 can be molded directly under terminal base members 419, 421. In one embodiment, terminal base member 419 is longer than terminal base member 421. The additional length of terminal base member 419 allows creepage and clearance distances to be met between the primary coil wire attachment 414 and secondary coil wire attachment 418. Although FIG. 4 illustrates 8 terminals, any number of terminals can be utilized.

The spool (not shown) of bobbin 404 is configured to have coil wire arrangements (such as primary coil wire arrangement 414 and secondary coil wire arrangement 415) wound around its circumference. In one example, the coil wire arrangement includes a primary winding and a secondary winding of a transformer 400. However, the coil wire arrangement can include any number of primary windings, secondary windings, and/or other windings. In the example shown, the primary coil wire arrangement 414 is wrapped around the spool of bobbin 404 between the upper flange 412 and barrier 416. The secondary coil wire arrangement 415 is wrapped around the spool of bobbin 404 between the barrier 416 and base flange 418. The primary coil wire arrangement 414 can terminate at any of terminals 420. The secondary coil wire arrangement 415 can terminate at any of terminals 422. Additionally, the vertical bobbin 404 can then be mounted on a PCB. In another embodiment, the coil wire arrangements can terminate directly onto the PCB. The side of bobbin 404 with terminals 420 may be referred to as the primary side while the side of bobbin 404 with terminals 422 may be referred to as the secondary side.

As shown, the vertical bobbin 404 includes a barrier 416 disposed in the middle of the vertical bobbin 404 between upper flange 412 and base flange 418. The barrier 416 can include any suitable insulating material such as plastic, insulating tape, and/or other suitable insulating material. In one embodiment, the barrier 416 is directly attached to the vertical bobbin 404. In another embodiment, the barrier 416 is an insulating material wound around the spool of the vertical bobbin 404. The width of barrier 416 (i.e., the length which separates the primary coil wire arrangement 414 and secondary coil wire arrangement 418) is sufficient to meet creepage requirements between windings. In a resonant power converter, such as a LLC or other suitable resonant power converter, a controlled amount of leakage inductance is desired. The leakage inductance is partially a function of the bobbin window fill factor and the number of turns of the coils of wire. The size of barrier 416 partially controls the size of the bobbin window and as such can partially control the amount of leakage.

The opening 410 of the vertical bobbin 404 extends through the upper flange 412, the spool (not shown), and the lower flange 418. The opening 410 can be configured to receive the inner core sections 426 and 428 of top core section 406 and bottom core section 408 along axis A. As such, the opening 410 can cause the spool to have an annular cross section (circular inner and outer circumference). However, the cross section of the spool can be similar to the cross section of the inner core sections 426 and 428 of top core section 406 and bottom core section 408.

The terminal base member 419 includes inner surfaces 434, which are configured to align the bottom core section 408 with the terminal base member 419. In addition, the shroud 402 includes core guides 424, which are configured to align the top core section 406 with the shroud 402. The top core section 406 and the bottom core section 408 can be coupled together in any suitable manner to enclose a portion of the vertical bobbin 404 and shroud 402. For example, in one embodiment, the top core section 406 and the bottom core section 408 can be coupled together via an adhesive such as glue, tape, and/or any suitable adhesive. In one example, top core section 406 and bottom core section 408 include a magnetically active core material, such as iron-ferrite material and/or other suitable magnetically active core material. In some embodiments, the magnetically active core material can also include non-magnetically active core elements. In one example, the non-magnetically active core elements may be utilized to control the effective permeability of the core set.

The shroud 402 covers (and protects) the primary coil wire arrangement 414. As will be further discussed, the shroud 402 includes an opening 425. The opening 425 can be configured to receive the inner core section 426 of top core section 406 along axis A. The opening 425 can have a cross section similar to the cross section of the inner core section 426. The shroud 402 slides onto the vertical bobbin 402 and around the primary coil wire arrangement 414. The shroud 402 also includes a window 427 on the same side as terminals 420 allowing access to the primary coil wire 414 arrangement such that the primary coil wire arrangement 414 may terminate at terminals 420 or the PCB. In one example, the shroud 402 is made of an insulating material that has a thickness based on a predetermined insulation thickness (e.g., 0.4 mm) that meets (or exceeds) minimum requirements for reinforced insulation between a winding and the top core section 406 and bottom core section 408. The shape of the shroud 402 contours the vertical bobbin 404 and is therefore similar to the shape of the vertical bobbin 404. In other words, the cross section of shroud 402 outlines the cross section of upper flange 412.

When coupled to the vertical bobbin 404, the shroud 402 insulates the primary coil wire arrangement 414 (primary winding) from the top core section 406 and the bottom core section 408. The shroud 402 allows for minimum creepage and clearance distances to be met between the secondary winding, the primary winding, and core.

Figure 5:
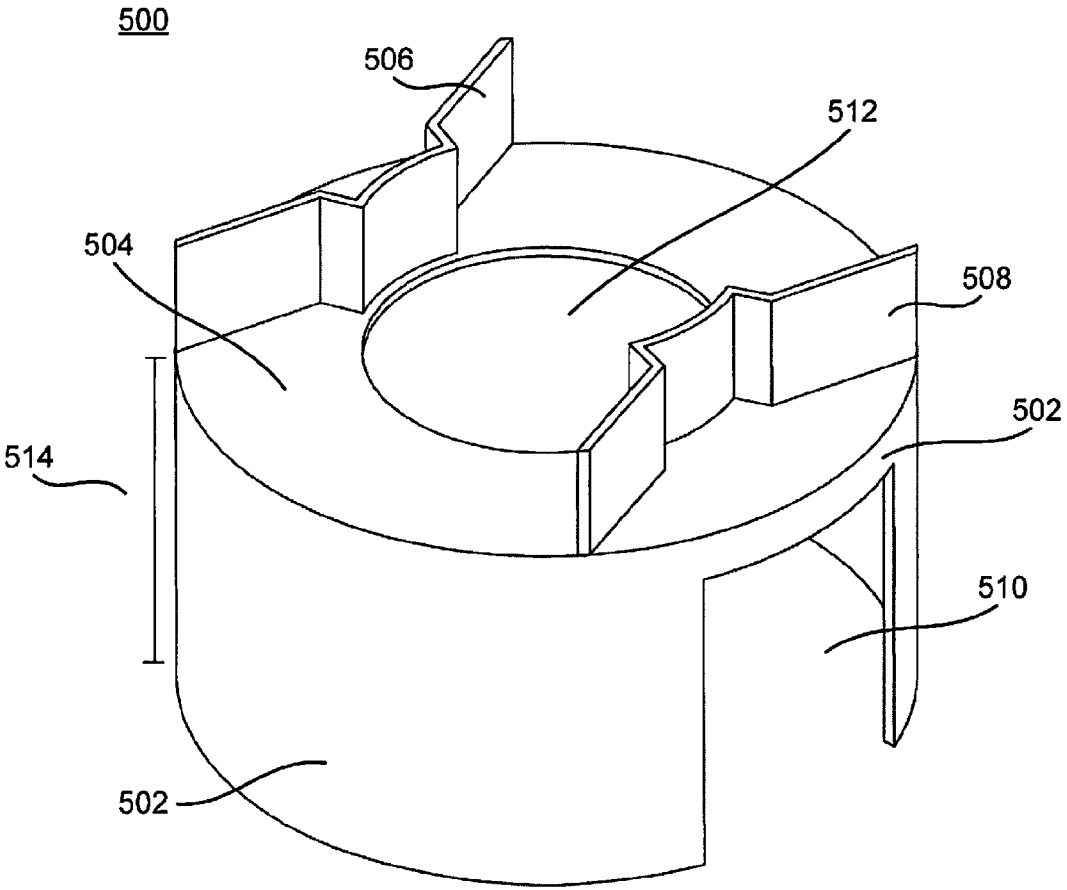
FIG. 5 is an example perspective view illustrating the shroud of FIG. 4.

Referring now to FIG. 5, an example perspective view of shroud 500 is depicted. The shroud 500 includes a first shrouding element 502, a second shrouding element 504, core guides 506 and 508, a window 510, and an opening 512.

Shroud 500 is one example of shroud 402 shown in FIG. 4. The height of the shroud 500 is referenced as 514.

As shown, the first shrouding element 502 contours the outline of the shape of the vertical bobbin 404, in particular the outline of upper flange 412, and thus has a substantially similar shape. Skilled artisans will appreciate that the shrouding element can be of any shape and is based on the shape of the vertical bobbin. The height 514 of the first shrouding element 502 (and shroud 500) is at least tall enough to cover between the upper flange 412 and barrier 416.

The second shrouding element 504 is substantially perpendicular to the first shrouding element 502. As shown, the first shrouding element 502 contours around the circumference of the second shrouding element 504. The second shrouding element 504 is substantially the same shape as the cross section of upper flange 412. The second shrouding element 504 includes the opening 512, which receives the top core section 406.

The second shrouding element 504 includes core guides 506 and 506. The core guides 506, 508 are configured to align the top core section 406 with the shroud 500. In one example, the height and width of the window 510 is large enough to allow access to the primary coil wire arrangement 414 such that the primary coil wire arrangement 414 may terminate at any of terminals 420 of the vertical bobbin 404 or a PCB. In addition, the distance along the surface of the first shrouding element 502 between the edge of window 510 and upper core section 406 is based on a predetermined creepage distance that meets (or exceeds) creepage distance requirements. For example, in one embodiment the distance along the surface of the first shrouding element 502 between the edge of window 510 and upper core section 406 can be sized to provide an overall creepage distance (between conductive elements of the transformer) of approximately 6 millimeters (mm). Although an overall creepage of approximately 6 mm is used in this example, other overall creepage distances are contemplated.

In one example, the shroud 500 is made of an insulating material thick enough to meet minimum requirements for reinforced insulation between a winding and the core 406 and 408. For example, in one embodiment, the shroud 500 has a thickness of at least 0.4 mm.

Figure 6:
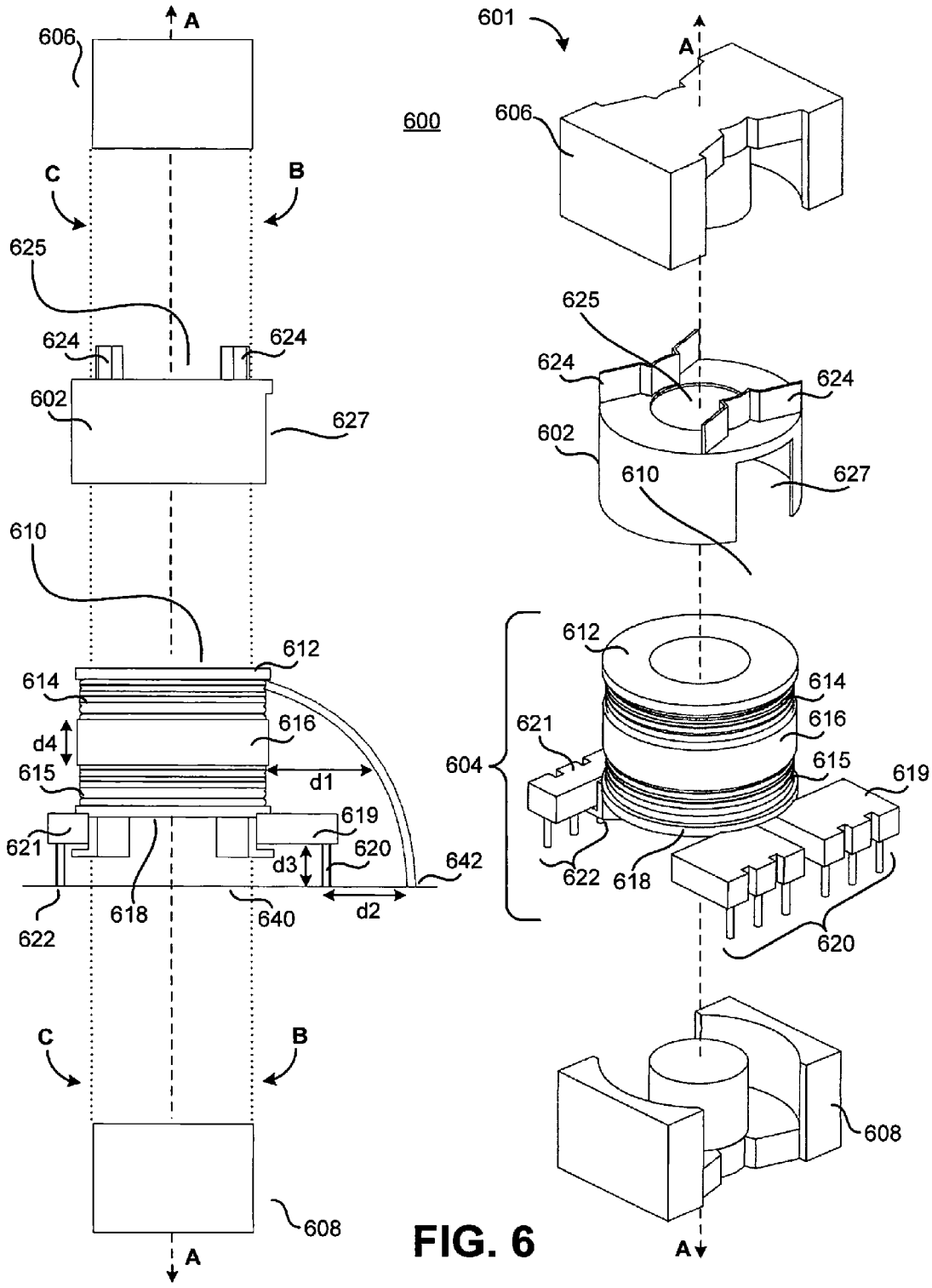
FIG. 6 is an example side view illustrating of an exploded view of the transformer and shroud of FIG. 4.

Referring now to FIG. 6, an example side view is shown along with of an example exploded view of a transformer 600. The transformer 600 is one example of transformer 400 discussed with respect to FIG. 4. The exploded view 601 correlates corresponding elements in the side view with the previously described transformer 400. As shown, exploded view 601 is similar to FIG. 4. The transformer 600 includes a shroud 602, a vertical bobbin 604, a top core section 606, and a bottom core section 608. The vertical bobbin 604 further includes an opening 610, an upper flange 612, a barrier 616, a primary coil wire arrangement 614, a secondary coil wire arrangement 615, a base flange 618, terminal base members 619 and 621, terminals 620 and 622, and wire end 642. The shroud 602 further includes core guides 624, opening 625, and window 627. Also illustrated in FIG. 6 are lines C and B and distances d1, d2, d3, and d4.

Those of ordinary skill in the art will appreciate that similarly named and numbered elements in FIG. 6 are substantially the same as those described with respect to FIG. 4. In the example shown in FIG. 6, lines C and B denote where the top core section 606 and the bottom core section 608 fit into the shroud 602 and bobbin 604. For the example, as shown in FIG. 6, primary coil wire arrangement 614 includes wire ends 642, which terminate into the printed circuit board PCB 640.

As noted above, the shroud 602 is of sufficient thickness to insulate the primary coil wire arrangement 614 from the top core section 606 and bottom core section 608. For example, in one embodiment, the shroud can be at least 0.4 mm thick. Other thicknesses are contemplated. The shroud 602 slides onto bobbin 604 and covers the upper flange 612 and the primary coil wire arrangement 614. In another example, the shroud 602 may also cover a portion of barrier 616. Although, the shroud 602 substantially covers the primary coil wire arrangement 614 in this example, the shroud 602 can cover the secondary coil wire arrangement 615 rather than the primary coil wire arrangement 614 if desired.

When the primary coil wire arrangement 614 and the secondary coil wire arrangement 615 are wound so that the coils of wire fill the entire bobbin window (corresponding maximum bobbin window fill factor), the minimum creepage between the primary coil wire arrangement 614 and the secondary coil wire arrangement 615 is approximately the length of barrier 616 (shown as length d4). The primary coil wire arrangement 614 terminates at PCB 640.

As shown, there is a clearance distance of distance d1 between the portion of the primary coil wire arrangement 614, which terminates at PCB 640 and the secondary coil wire arrangement. In the example shown, the primary coil wire arrangement 614 includes wire end 642, which terminates on the PCB 640. The creepage distance between the wire end 642 and the bottom core section 608 is approximately the sum of distance d2 (the distance between the wire end and terminal 620), the distance d3 (corresponding to the length of terminal 620), and the distance along the entire lower surface of the terminal base member 619 and base flange 618 from the terminal 620 to line B. In general, skilled artisans are mostly concerned with the total creepage distance for safety regulation. For example, the sum of all the creepage distances between the primary winding and the secondary winding can be greater than the minimum required creepage distance for safety regulations. The same is true for creepage distances between either the primary winding or secondary winding and the core of the transformer.

Figure 7:
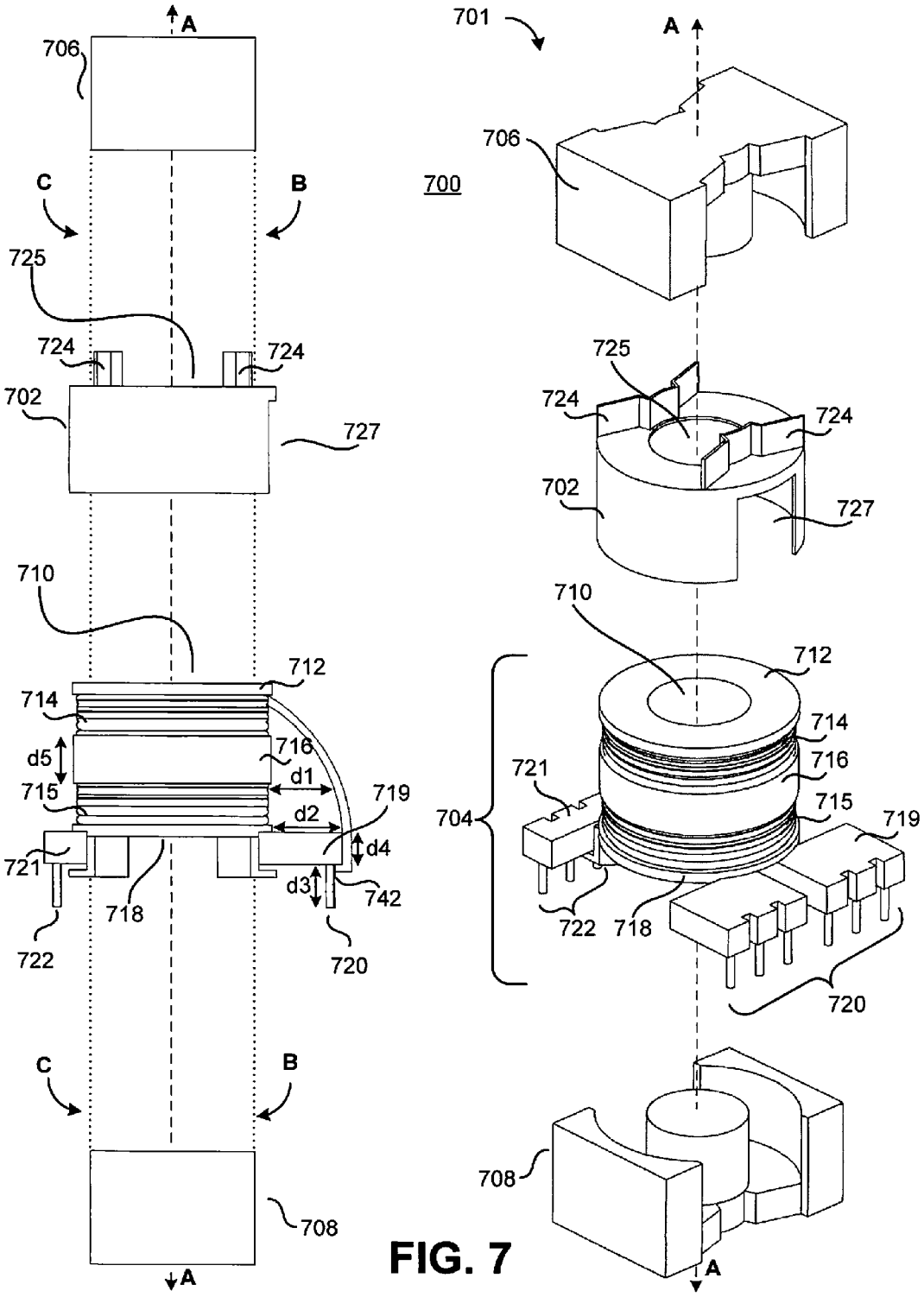
FIG. 7 is another example side view illustrating an exploded view of the transformer and shroud of FIG. 4.

Referring now to FIG. 7, an example side view is shown along with an exploded view of a transformer 700. The transformer 700 is one example of transformer 400 discussed with respect to FIG. 4. The exploded view 701 correlates corresponding elements in the side view with the previously described transformer 400. As shown, exploded view 701 is similar to FIG. 4. The transformer 700 includes shroud 702, a vertical bobbin 704, a top core section 706, and a bottom core section 708. The vertical bobbin 704 further includes an opening 710, an upper flange 712, a barrier 716, a primary coil wire arrangement 714, a secondary coil wire arrangement 715, a base flange 718, terminal base members 719 and 721, terminals 720 and 722, and wire end 742. The shroud 702 further includes core guides 724, opening 725, and window 727. Further illustrated in FIG. 7 are lines C and B and distances d1, d2, d3, d4, and d5.

Similarly named and numbered elements in FIG. 7 correspond with those as described above with respect to FIG. 4. In the example shown in FIG. 7, lines C and B denote where the top core section 706 and the bottom core section 708 fit into the shroud 702 and bobbin 704. In this example, the primary coil wire arrangement 714 includes wire end 742, which terminates at terminals 720.

As noted above, the shroud 702 is of sufficient thickness (e.g., at least 0.4 mm) to insulate the primary coil wire arrangement 714 from the top core section 706 and bottom core section 708. The shroud 702 slides onto bobbin 704 and covers the upper flange 712 and the primary coil wire arrangement 714. In another example, the shroud 702 also covers at least a portion of barrier 716. Although, the shroud 702 substantially covers the primary coil wire arrangement 714 in this example, the shroud 702 can cover the secondary coil wire arrangement 715 rather than the primary coil wire arrangement 714 if desired.

The minimum creepage between the primary coil wire arrangement 714 and the secondary coil wire arrangement 715 is approximately the length of barrier 716 (shown as length d4). In some embodiments, the primary coil wire arrangement 714 and the secondary coil wire arrangement 715 are wound so that the coils of wire fill the entire bobbin window (corresponding maximum bobbin window fill factor). The primary coil wire arrangement 714 terminates at one or more terminals 720. As shown, the primary coil wire arrangement 715 is wound around terminal 720 such that the wire rests upon part of one surface of terminal base member 719. As such, there is additional creepage distance of length d2 along another surface of terminal base member 719 between the primary coil wire arrangement 714 and the secondary coil wire arrangement 715. There is also a clearance distance of distance d1 between the primary coil wire arrangement 715, which terminates at terminal 720, and the secondary coil wire arrangement 715.

As shown, the primary coil wire arrangement 714 includes wire end 742 that terminates at terminal 720. In this example, the creepage distance between the wire end 742 and the bottom core section 708 is approximately the distance along the entire lower surface of the terminal base member 719 and base flange 718 from the terminal 720 to line B. Depending on where the wire end 742 is positioned along terminal 720, the creepage distance between the wire end 742 and the bottom core section 708 may also include some fractional value of distance d3. If the wire end 742 is wound at the bottom of terminal 720, the creepage distance between the wire end 742 and the bottom core section 708 may also include the value of distance d3 (corresponding to the length of terminal 720). In general, skilled artisans are mostly concerned with the total creepage distance for safety regulation. For example, the sum of all the creepage distances between the primary winding and the secondary winding can be greater than the minimum required creepage distance for safety regulations. The same is true for creepage distances between either the primary winding or secondary winding and the core of the transformer.

Figure 8:
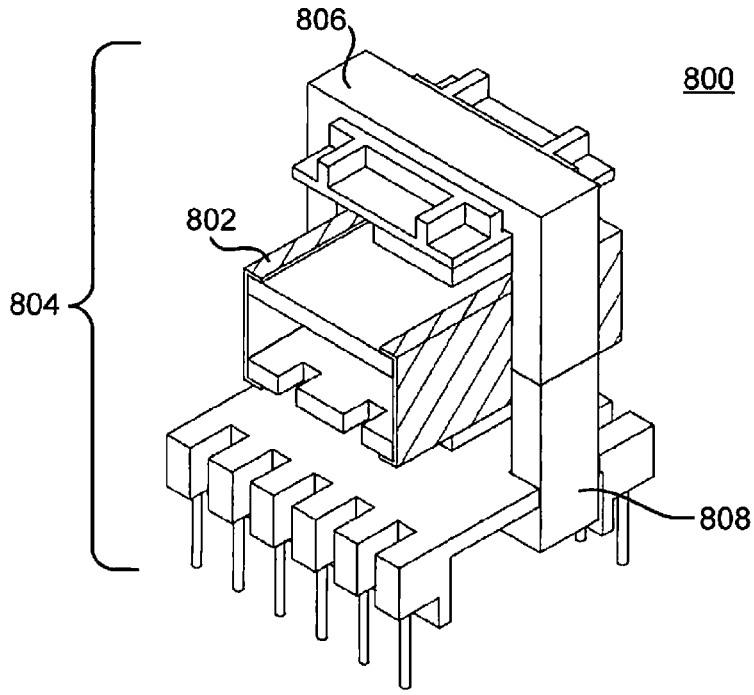
FIG. 8 is an example collapsed view illustrating the transformer and shroud of FIGS. 1A and 1B.

Referring now to FIG. 8, an example collapsed view of a transformer 800 is depicted. The transformer 800 is one example of transformer 100 discussed with respect to FIGS. 1A and 1B. Similarly named and numbered elements in FIG. 8 correlate with elements of FIGS. 1A and 1B. As shown, the transformer 800 includes shroud 802, a vertical bobbin 804, a top core section 806, and a bottom core section 808. More specifically, FIG. 8 illustrates the shroud 802, the vertical bobbin 804, the top core section 806, and the bottom core section 808 assembled together.

Figure 9:
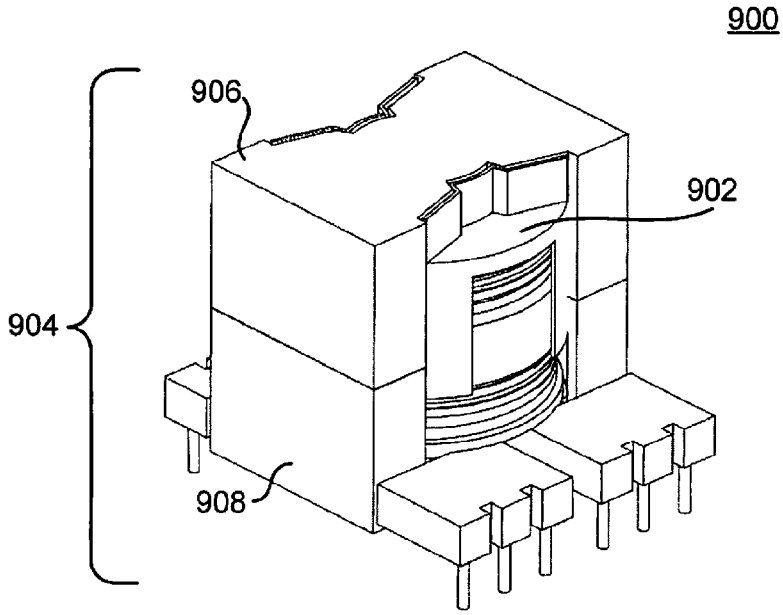
FIG. 9 is an example collapsed view illustrating the transformer and shroud of FIG. 4.

FIG. 9 is an example collapsed view illustrating the transformer and shroud of FIG. 4. Transformer 900 is one example of transformer 400 discussed with respect to FIG. 4. As such, similarly named and numbered elements in FIG. 9 correlate with elements of FIG. 4. As shown, the transformer 900 includes shroud 902, a vertical bobbin 904, a top core section 906, and a bottom core section 908. More specifically, FIG. 9 illustrates the shroud 902, the vertical bobbin 904, the top core section 906, and the bottom core section 908 assembled together.

As noted above, among other advantages, the shroud partially covers a vertical bobbin to protect one of the windings (e.g., primary or secondary) from the core. The shroud also allows for creepage and clearance distances to be met while utilizing the entire bobbin window. Accordingly, the shroud preserves the bobbin window while reducing (or minimizing) the size of the vertical bobbin. As such, the shroud allows for a compact transformer structure, which can reduce size and cost of the overall power converter. Other advantages will be recognized by those of ordinary skill in the art.

Figure 10A:
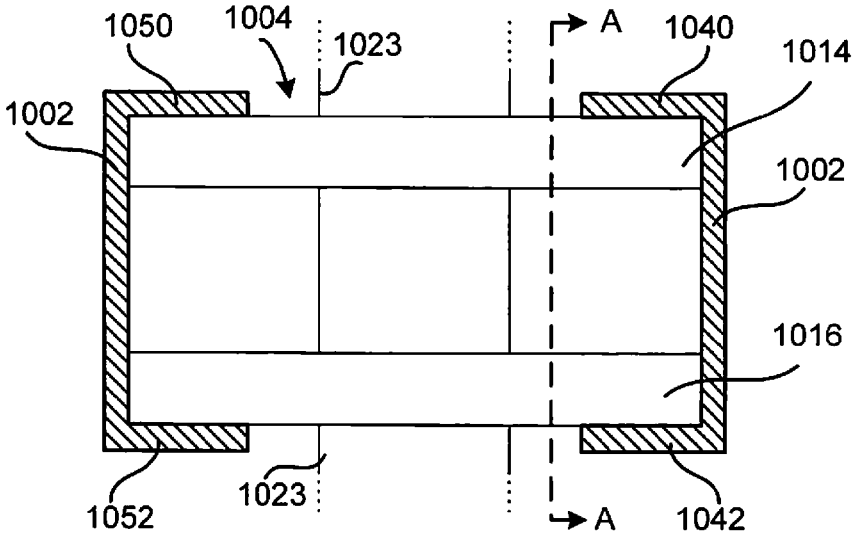
FIG. 10A is an example front view of an embodiment of a shroud coupled to the bobbin of FIG. 1A.

Referring now to FIG. 10A, an example front view of a shroud 1002 and a bobbin 1004 similar to those of FIGS. 1A-2 is depicted. The bobbin 1004 includes a first flange 1014 (e.g., a middle flange), a second flange 1016 (e.g., a lower flange), and a spool 1023. The shroud 1002 includes an upper attachment lip 1050 and a lower attachment lip 1052. As shown, FIG. 10A depicts the shroud 1002 coupled to the first flange 1014 and the second flange 1016.

As noted above, the shroud 1002 substantially covers (and protects) coil wire arrangements wrapped around the spool 1023 between the first flange 1014 and the second flange 1016. As shown in this example, the upper attachment lip 1050 and the lower attachment lip 1052 align and couple the shroud 1002 to the first flange 1014 and the second flange 1016. As shown, the upper attachment lip 1050 attaches to the upper surface of first flange 1014 and the lower attachment lip 1052 attaches to the lower surface of the second flange 1015. In other words, the first flange 1014 and the second flange 1016 are disposed between upper attachment lip 1050 and lower attachment lip 1052.

Figure 10B:
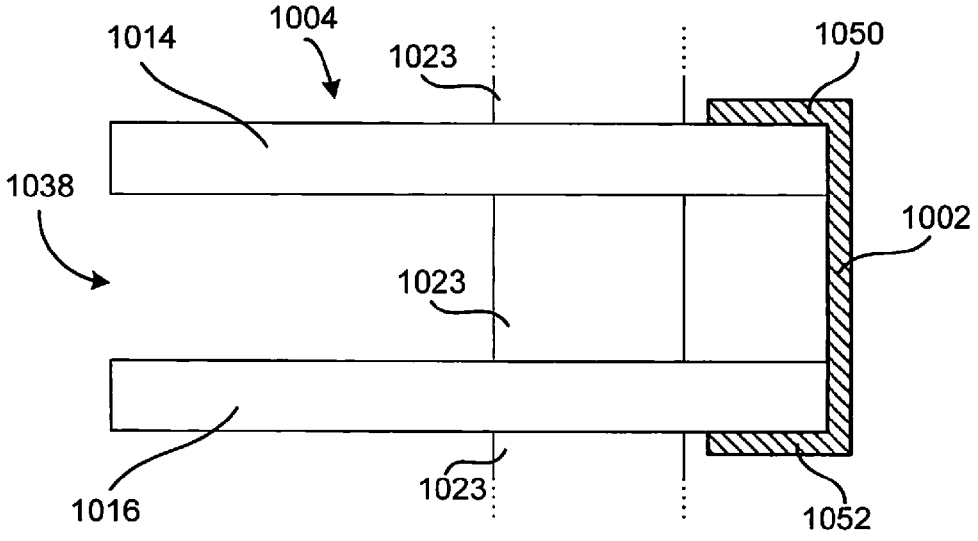
FIG. 10B is an example cross-section of the shroud and bobbin along line A-A of FIG. 10A.

Referring now to FIG. 10B, an example cross-section of the shroud 1002, the first flange 1014, the second flange 1016, and spool 1023 along line A-A of FIG. 10A is illustrated. The example cross-section of the shroud 1002 includes a window 1038, the upper attachment lip 1050, and the lower attachment lip 1052.

The window 1038 allows access to coils of wire wrapped around spool 1023 at one end of the bobbin 1004. At the opposite end of the bobbin, the shroud 1002 covers the coils of wire wrapped between the first flange 1014 and the second flange 1016. Additionally, as noted above, the upper attachment lip 1050 attaches to the upper surface of middle flange 1014 and the lower attachment lip 1052 attaches to the lower surface of the lower flange 1015.

FIGS. 11A-18B describe various embodiments of the shroud 102, 202, 1002 as described with reference to FIGS. 1A, 1B, 2, 10A, and 10B. In these embodiments, the flange includes a flange edge and the shrouding element includes a shrouding edge that is operatively coupled to the flange edge. The flange edge and the shrouding edge have at least one complementary corrugation. For example, in one embodiment, the flange edge can include one or more grooves and the shrouding edge can include one or more protrusions that are complementary to the groove(s). In another embodiment, the shrouding edge can include one or more grooves and the flange edge can include one or more protrusions that are complementary to the groove(s). As noted above, the creepage distance is the length of the shortest path between two conductive parts along the surface of the structure separating them. As such, the complementary corrugation of the flange edge and the shrouding edge increases the length of the path between two conductive parts and thus increases the creepage distance, which can be desirable. The size and the number of corrugations can be selected to provide any suitable creepage distance. For example, in one embodiment, the size and number of corrugations can be selected to provide a creepage distance of at least 6 mm. Other creepage distances are contemplated.

Figure 11A:
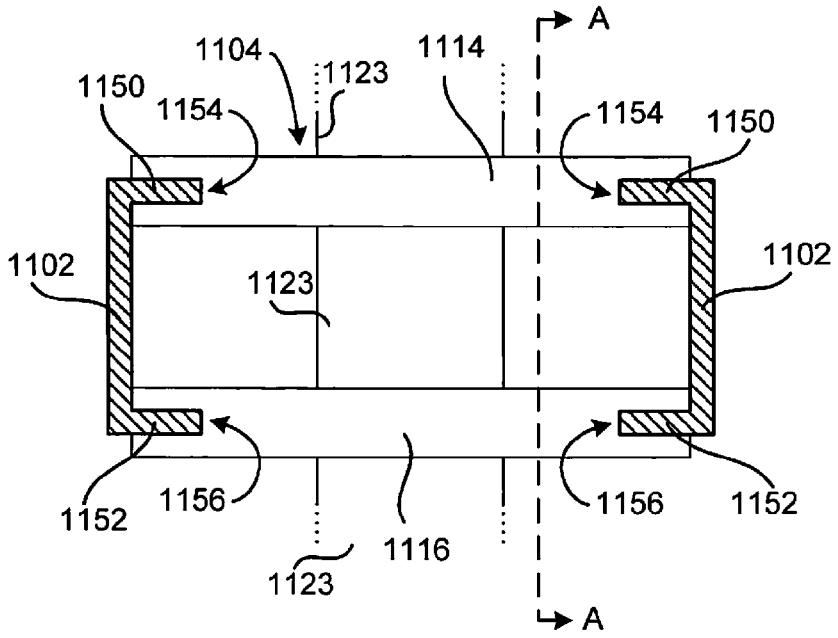
FIG. 11A is an example front view of an embodiment of a shroud coupled to the bobbin of FIG. 1A.

Referring now to FIG. 11A, an example front view of a shroud 1102 and a bobbin 1104 is depicted. The bobbin 1104 includes a first flange 1114 (e.g., middle flange), a second flange 1116 (e.g., lower flange), and a spool 1123. The first flange 1114 includes a first flange edge 1154 having a corrugation (e.g., a groove) and the second flange 1116 includes a second flange edge 1156 having a corrugation (e.g., a groove). In one example, the first flange edge 1154 and the second flange edge 1156 having the respective corrugation substantially circumscribe the first flange 1114 and the second flange 1116, respectively. In this example, the first flange edge 1154 and the second flange edge 1156 having the respective corrugation run along the sides and back of the respective flange 1114, 1116, but not the front. However, the respective corrugation may run along the front of the respective flange 1114, 1116.

The shroud 1102 includes an upper attachment lip 1150 and a lower attachment lip 1152. As shown, the upper attachment lip 1150 protrudes from the shroud 1102 creating a corrugation (e.g., protrusion) complementary to the first flange edge 1154. Likewise, the lower attachment lip 1152 protrudes from the shroud 1102 creating a corrugation (e.g., protrusion) complementary to the second flange edge 1154.

As shown in this example, the upper attachment lip 1150 and the lower attachment lip 1152 align and attach the shroud 1102 to the first flange 1114 and the second flange 1116, respectively. More specifically, the corrugation (e.g., protrusion) of the upper attachment lip 1150 and the corrugation (e.g., protrusion) of the lower attachment lip 1152 slide and align into the corrugation (e.g., groove) of the first and second flange edges 1154 and 1156, respectively. The complementary corrugation of the flanges 1114, 1116 with respect to the shroud lips 1150, 1152 provide additional creepage distance between coil wire arrangements wound on the spool 1123 between the first flange 1114 and the second lower flange 1116, and coil wire arrangements wound on the upper or lower portion of the spool 1123. The additional creepage distance is provided along the surface of first and second flange edges 1154 and 1156.

Figure 11B:
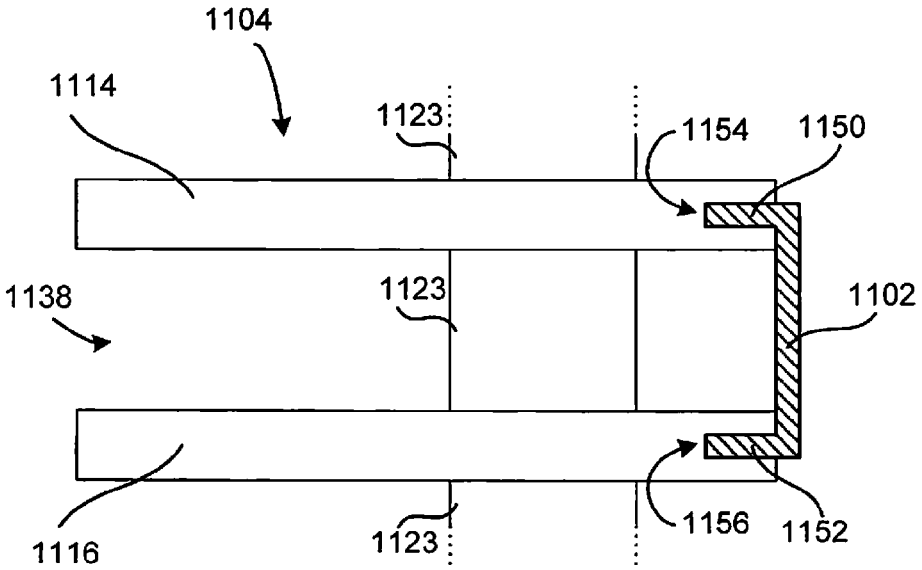
FIG. 11B is an example cross-section of the shroud and bobbin along line A-A of FIG. 11A.

Referring now to FIG. 11B, an example cross-section of the shroud 1102, the first flange 1114, the second flange 1116, the spool 1123, and the edges 1154, 1156 along line A-A of FIG. 11A is depicted. As shown, the shroud 1102 includes a window 1138, the upper attachment lip 1150, and the lower attachment lip 1152.

The window 1138 allows access to coils of wire wound around the spool 1123 at one end of the bobbin 1104. At the opposite end of the bobbin 1104, the shroud 1102 covers the coils of wire wound between the first flange 1114 and the second flange 1116. In addition, the upper attachment lip 1150 attaches to the first flange edge 1154 and the lower attachment lip 1152 attaches to the second flange edge 1156. As shown in this example, the flange edges 1154, 1156 are disposed along the entire width of one side of the first flange 1114 and the second flange 1116, respectively.

Figure 12A:
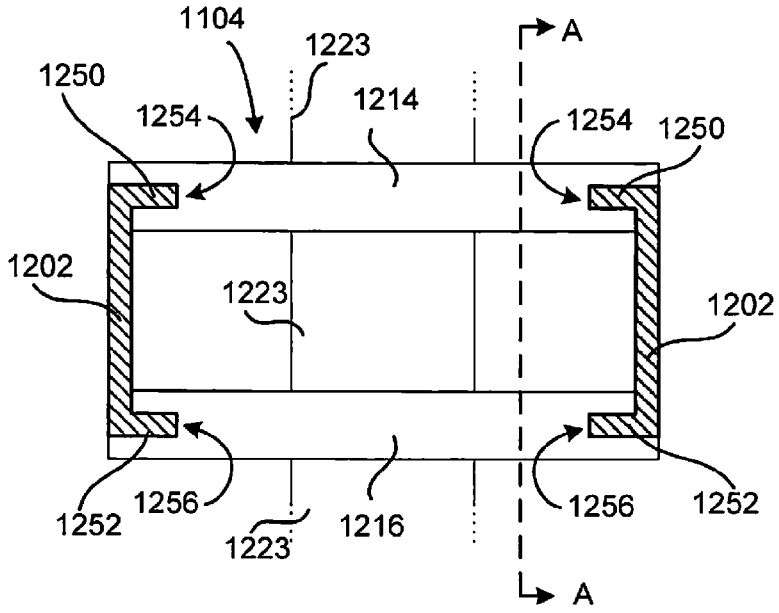
FIG. 12A is an example front view of an embodiment of a shroud coupled to the bobbin of FIG. 1A.

Referring now to FIG. 12A, an example front view of a shroud 1202 and a bobbin 1204 is depicted. The bobbin 1204 includes a first flange 1214 (e.g., a middle flange), a second flange 1216 (e.g., a lower flange), and a spool 1223. The first flange 1214 includes a first flange edge 1254 having a first corrugation (e.g., a groove) and the second flange 1216 includes a second flange edge 1256 having a corrugation (e.g., a groove). In one example, the first flange edge 1254 and the second flange edge 1256 having the respective corrugation substantially circumscribe the first flange 1214 and the second flange 1216, respectively. In this example, the first flange edge 1254 and the second flange edge 1256 having the respective corrugation run along the sides and back of the respective flange 1214, 1216, but not the front. However, the respective corrugation may run along the front of the respective flange 1214, 1216.

The shroud 1202 includes an upper attachment lip 1250 and a lower attachment lip 1252. As shown, the upper attachment lip 1250 protrudes from the shroud 1202 creating a corrugation (e.g., protrusion) complementary to the first flange edge 1254. Likewise, the lower attachment lip 1252 protrudes from the shroud 1202 creating a corrugation (e.g., protrusion) complementary to the second flange edge 1254.

As shown in this example, the upper attachment lip 1250 and the lower attachment lip 1252 align and attach the shroud 1202 to the first flange 1214 and the second flange 1216, respectively. More specifically, the corrugation (e.g., protrusion) of the upper attachment lip 1250 and the corrugation (e.g., protrusion) of the lower attachment lip 1252 slide and align into the corrugation (e.g., groove) of the first and second flange edges 1254 and 1256, respectively. The complementary corrugation of the flanges 1214, 1216 with respect to the shroud lips 1250, 1252 provide additional creepage distance between coil wire arrangements wound on the spool 1223 between the first flange 1214 and the second lower flange 1216, and coil wire arrangements wound on the upper or lower portion of the spool 1223. The additional creepage distance is provided along the surface of first and second flange edges 1254 and 1256.

The example shown in FIG. 12A is similar to the example shown in FIG. 11A, however, the widths of the upper surface and lower surface of both the first flange 1214 and the second flange 1216 are different. As shown in FIG. 12A, the width of the upper surface of first flange 1214 is greater than the width of the lower surface of first flange 1214 such that the shroud 1202 is flush with the upper surface of the first flange 1214. In addition, the width of the upper surface of the second flange 1216 is smaller than the width of the lower surface of the second flange 1216 such that the shroud 1202 is flush with the lower surface of the second flange 1216. This configuration allows preservation of the bobbin window.

Figure 12B:
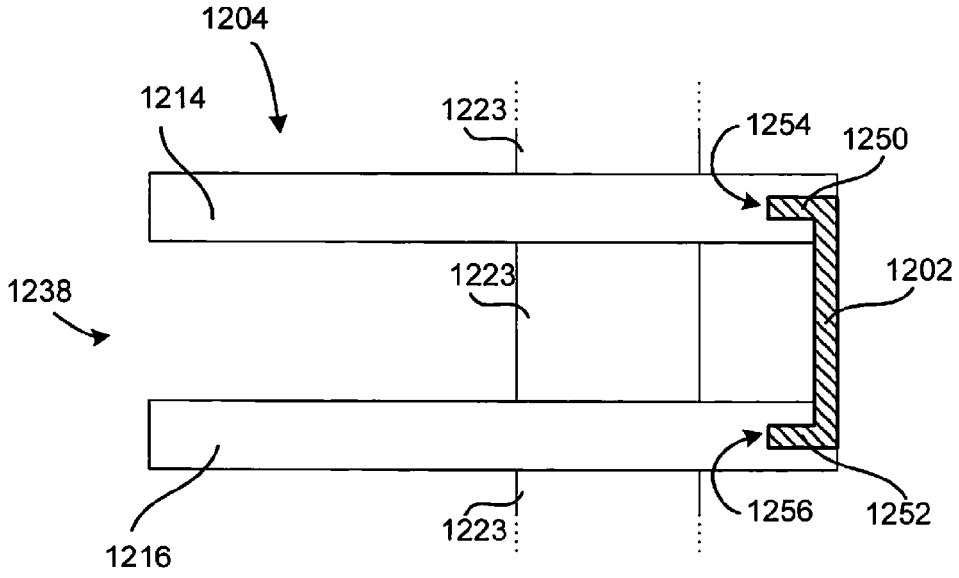
FIG. 12B is an example cross-section of the shroud and bobbin along line A-A of FIG. 12A.

Referring now to FIG. 12B, an example cross-section of the shroud 1202, middle flange 1214, lower flange 1216, spool 1223, and flange edges 1254 and 1256 along line A-A of FIG. 12A is depicted. As shown, the shroud 1202 includes a window 1238, the upper attachment lip 1250, and the lower attachment lip 1252.

FIG. 12B is similar to the embodiment shown in FIG. 11B, however, the widths of the upper surface and lower surface of both the first flange 1214 and the second flange 1216 are different such that the shroud 1202 is flush with the first flange 1214 and the second flange 1216 when the shroud 1202 is coupled to the bobbin 1204.

Figure 13A:
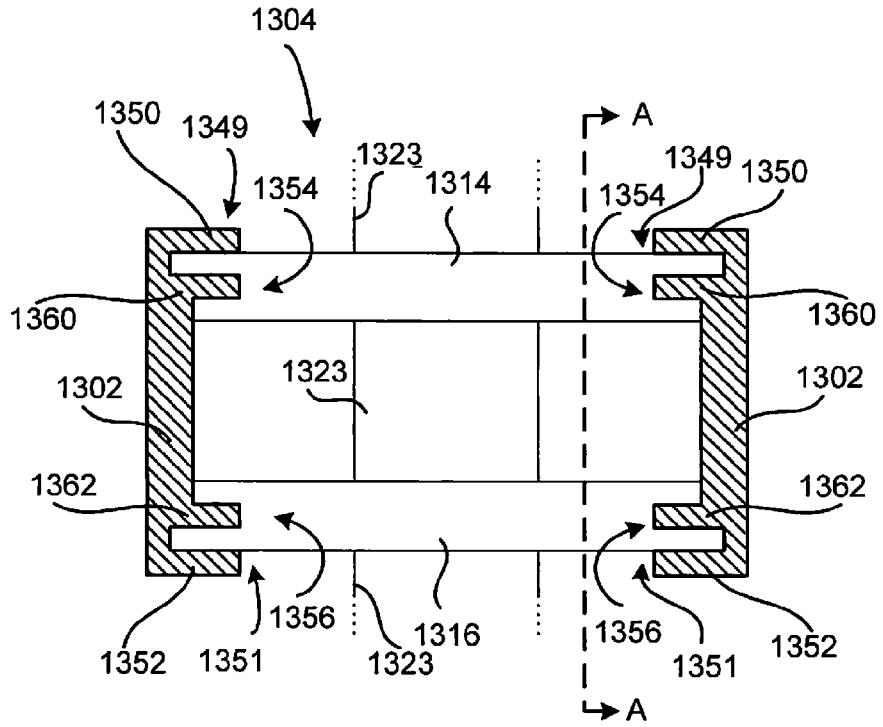
FIG. 13A is an example front view of an embodiment of a shroud coupled to the bobbin of FIG. 1A.

Referring now to FIG. 13A, an example front view of a shroud 1302 and a bobbin 1304 is depicted. The bobbin 1304 includes a first flange 1314 (e.g., a middle flange), a second flange 1316 (e.g., a lower flange), and a spool 1323. The first flange 1314 includes a first flange edge 1354 having a corrugation (e.g., a groove or two protrusions) and the second flange edge 1316 includes a second flange edge 1356 having a corrugation (e.g., a groove or two protrusions). In one example, the first flange edge 1354 and the second flange edge 1356 having the respective corrugation substantially circumscribe the first flange 1314 and the second flange 1316, respectively. In this example, the first flange edge 1354 and the second flange edge 1356 having the respective corrugation run along the sides and back of the respective flange 1314, 1316, but not the front. However, the respective corrugation may run along the front of the respective flange 1314, 1316.

The shroud 1302 includes a first shrouding edge 1349 and a second shrouding edge 1351. In one example, the first shrouding edge 1349 and the second shrouding edge 1351 substantially circumscribe the shroud 1302 (e.g., along both sides and the back of the shroud). The first shrouding edge 1349 includes a corrugation (e.g., a groove or two protrusions) that is complementary to the corrugation of the first flange edge 1354. More specifically, the first shrouding edge 1349 includes a first upper attachment lip 1350 and a second upper attachment lip 1360 that creates the corrugation. The second shrouding edge 1351 includes a corrugation (e.g., a groove or two protrusions) that is complementary to the corrugation of the second flange edge 1356. More specifically, the second shrouding edge 1351 includes a first lower attachment lip 1352 and a second lower attachment lip 1362 that creates the corrugation.

The first upper attachment lip 1350 and the first lower attachment lip 1352 align and attach the shroud 1302 to the first flange 1314 and the second flange 1316, respectively. In the example shown, the first upper attachment lip 1350 attaches to the upper surface of first flange 1314 and the first lower attachment lip 1352 attaches to the lower surface of the second flange 1316.

Additionally, the second upper attachment lip 1360 and the second lower attachment lip 1362 also align (and attach) the shroud 1302 to the first flange 1314 and the second flange 1316. The second upper attachment lip 1360 and the second lower attachment lip 1362 slide into a respective corrugation of the flange edges 1354 and 1356, respectively. The complementary corrugation of the flanges 1314, 1316 with respect to the shrouding edges 1349, 1351 provide additional creepage distance between coil wire arrangements wound on the spool 1323 between the first flange 1314 and the second lower flange 1316, and coil wire arrangements wound on the upper or lower portion of the spool 1323. The additional creepage distance is provided along the surface of first and second flange edges 1354 and 1356.

The widths of the upper surface and lower surface of both the first flange 1314 and the second flange 1316 can be different (e.g., similar to FIGS. 12A and 12B). Furthermore, the widths of the upper surface and lower surface of both the first flange 1314 and second flange 1316 can be substantially equal (e.g., similar to FIGS. 11A and 11B).

Figure 13B:
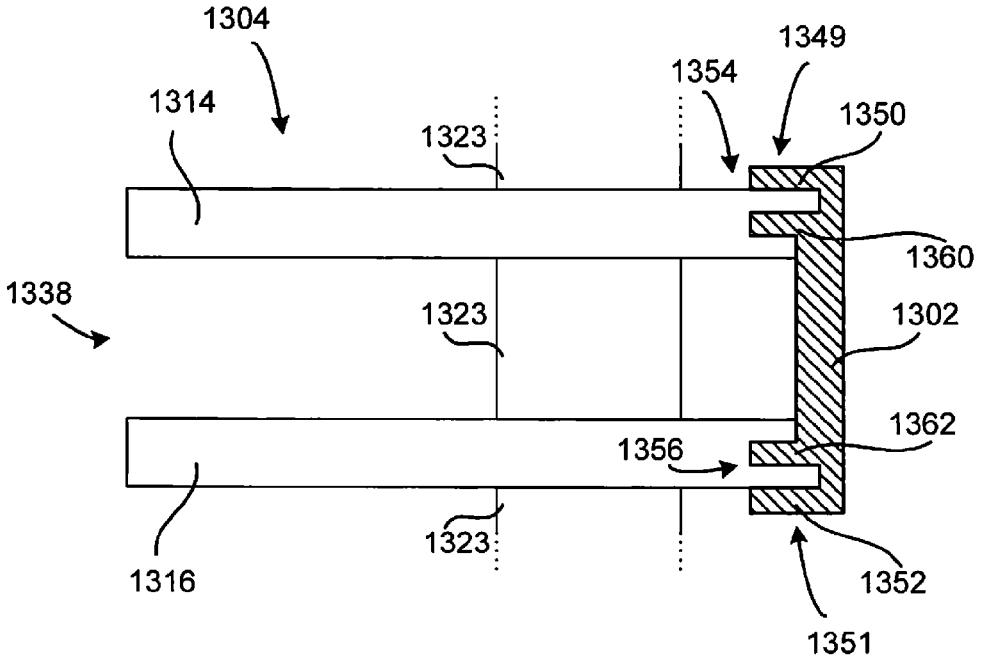
FIG. 13B is an example cross-section of the shroud and bobbin along line A-A of FIG. 13A.

Referring now to FIG. 13B, an example cross-section of the shroud 1302, the first flange 1314, the second flange 1316, the spool 1323, and the flanges edges 1354, 1356 along line A-A of FIG. 13A is depicted. As shown, the shroud 1302 includes a window 1338, the first shrouding edge 1349, and the second shrouding edge 1351.

The window 1338 allows access to coils of wire wound around spool 1323 at one end of the bobbin 1304. At the opposite end of the bobbin 1304, the shroud 1302 covers the coils of wire wound between the first flange 1314 and the second flange 1316. In addition, the first upper attachment lip 1350 attaches to upper surface of the first flange 1314 while the first lower attachment lip 1352 attaches to the lower surface of the second flange 1316. Further, the second upper attachment lip 1360 and the second lower attachment lip 1362 slide into a respective corrugation of the flange edges 1354 and 1356, respectively. As shown in this example, the flange edges 1354 and 1356 are disposed along the entire width of one side of the first flange 1314 and the second flange 1316. In addition, attachment lips 360 and 1362 are disposed on the entire width of the inner surface of shroud 1302.

Figure 14A:
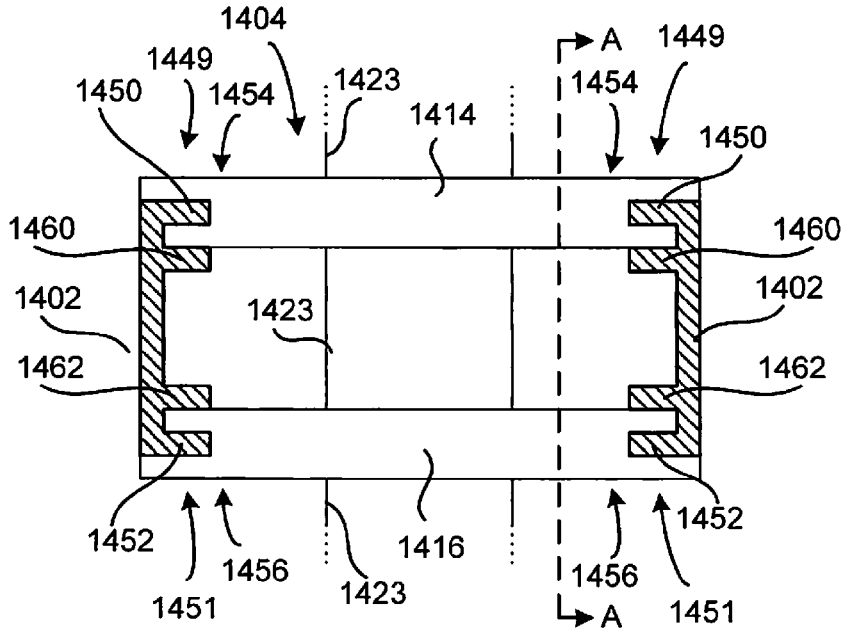
FIG. 14A is an example front view of an embodiment of a shroud coupled to the bobbin of FIG. 1A.

Referring now to FIG. 14A, an example front view of a shroud 1402 and a bobbin 1404 is depicted. The bobbin 1404 includes a first flange 1414, a second flange 1416, and a spool 1423. The first flange 1414 includes a first flange edge 1454 having a corrugation (e.g., a groove or two protrusions) and the second flange edge 1416 includes a second flange edge 1456 having a corrugation (e.g., a groove or two protrusions). In one example, the first flange edge 1454 and the second flange edge 1456 having the respective corrugation substantially circumscribe the first flange 1414 and the second flange 1416, respectively. In this example, the first flange edge 1454 and the second flange edge 1456 having the respective corrugation run along the sides and back of the respective flange 1414, 1416, but not the front. However, the respective corrugation may run along the front of the respective flange 1414, 1416.

The shroud 1402 includes a first shrouding edge 1449 and a second shrouding edge 1451. In one example, the first shrouding edge 1449 and the second shrouding edge 1451 substantially circumscribe the shroud 1402 (e.g., along both sides and the back of the shroud). The first shrouding edge 1449 includes a corrugation (e.g., a groove or two protrusions) that is complementary to the corrugation of the first flange edge 1454. More specifically, the first shrouding edge 1449 includes a first upper attachment lip 1450 and a second upper attachment lip 1460 that creates the corrugation. The second shrouding edge 1451 includes a corrugation (e.g., a groove or two protrusions) that is complementary to the corrugation of the second flange edge 1456. More specifically, the second shrouding edge 1451 includes a first lower attachment lip 1452 and a second lower attachment lip 1462 that creates the corrugation.

The example shown in FIG. 14A is similar to FIG. 13A. However, in this example, the first upper attachment lip 1450 and the first lower attachment lip 1452 slide and align into the corrugation (e.g., groove) of the respective flange edge 1454, 1456. Further, the second upper attachment lip 1460 attaches to the lower surface of the first flange 1414 and the second lower attachment lip 1462 attaches to the upper surface of second flange 1416.

The widths of the upper surface and lower surface of both the first flange 1414 and the second flange 1416 can be different (similar to FIGS. 12A and 12B). Furthermore, the widths of the upper surface and lower surface of both the first flange 1414 and the second flange 1416 can also be substantially equal (similar to FIGS. 11A and 11B).

Figure 14B:
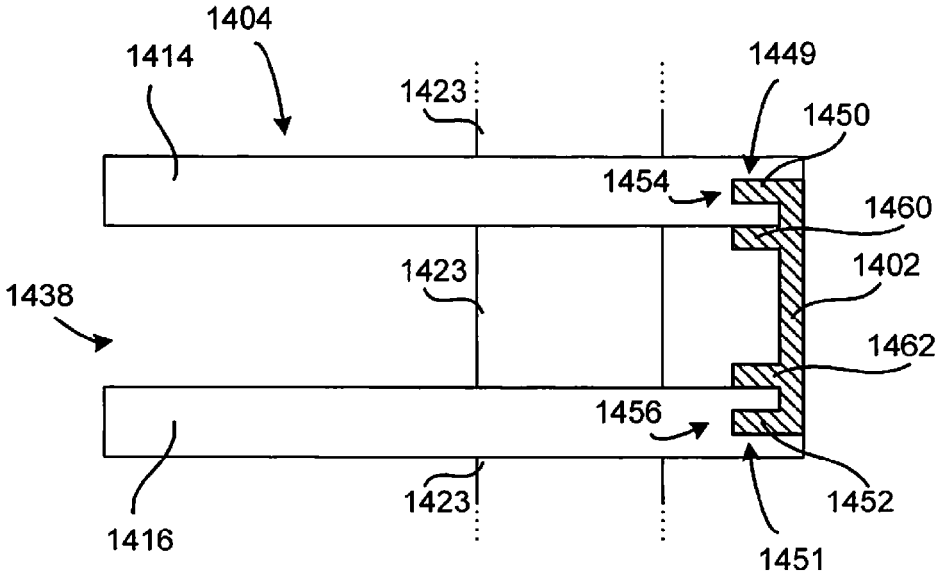
FIG. 14B is an example cross-section of the shroud and bobbin along line A-A of FIG. 14A.

Referring now to FIG. 14B, an example cross-section of the shroud 1402, the first flange 1414, the second flange 1416, the spool 1423, and the flange edges 1454, 1456 along line A-A of FIG. 13A is depicted. As shown, the shroud 1402 includes a window 1438, the first shrouding edge 1449, and the second shrouding edge 1451.

The example shown in FIG. 14B is similar to FIG. 13B. However, in the example shown, the first upper attachment lip 1450 and the first lower attachment lip 1452 slide and align into corrugations (e.g., grooves) of the flange edges 1454 and 1456, respectively. Further, the second upper attachment lip 1460 attaches to the lower surface of the first flange 1414 and the second lower attachment lip 1462 attaches to the upper surface of second flange 1416.

Figure 15A:
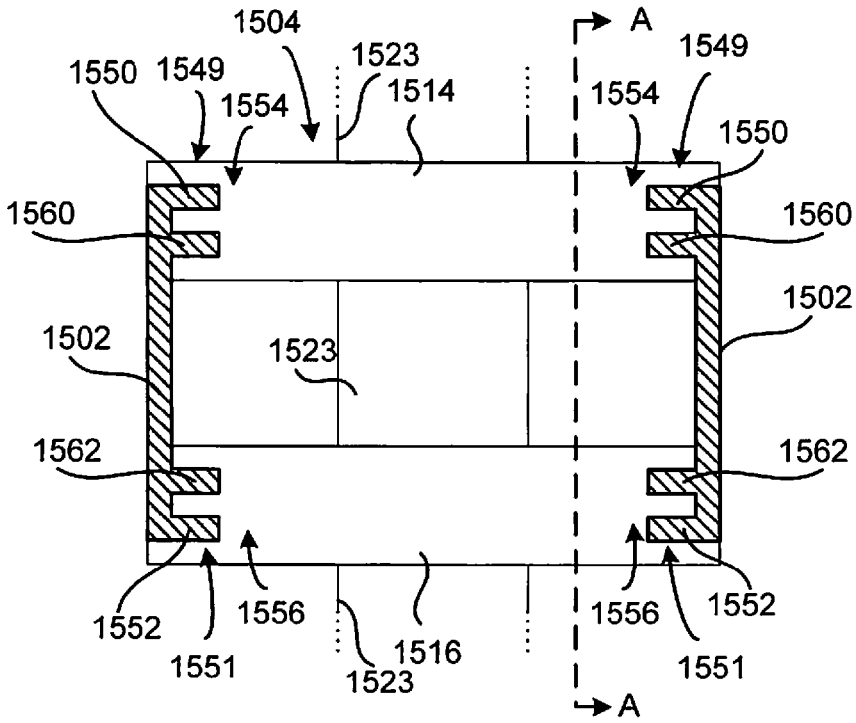
FIG. 15A is an example front view of an embodiment of a shroud coupled to the bobbin of FIG. 1A.

Referring now to FIG. 15A, an example front view of a shroud 1502 and a bobbin 1504 is depicted. The bobbin 1504 includes a first flange 1514 (e.g., a middle flange), a second flange 1516 (e.g., a lower flange), and a spool 1523. The first flange 1514 includes a first flange edge 1554 having a corrugation (e.g., two grooves or three protrusions) and the second flange edge 1516 includes a second flange edge 1556 having a corrugation (e.g., two grooves or three protrusions). In one example, the first flange edge 1554 and the second flange edge 1556 having the respective corrugation substantially circumscribe the first flange 1514 and the second flange 1516, respectively. In this example, the first flange edge 1554 and the second flange edge 1556 having the respective corrugation run along the sides and back of the respective flange 1514, 1516, but not the front. However, the respective corrugation may run along the front of the respective flange 1514, 1516.

The shroud 1502 includes a first shrouding edge 1549 and a second shrouding edge 1551. In one example, the first shrouding edge 1549 and the second shrouding edge 1551 substantially circumscribe the shroud 1502 (e.g., along both sides and the back of the shroud). The first shrouding edge 1549 includes a corrugation (e.g., a groove or two protrusions) that is complementary to the corrugation of the first flange edge 1554. More specifically, the first shrouding edge 1549 includes a first upper attachment lip 1550 and a second upper attachment lip 1560 that creates the corrugation. The second shrouding edge 1551 includes a corrugation (e.g., a groove or two protrusions) that is complementary to the corrugation of the second flange edge 1556. More specifically, the second shrouding edge 1551 includes a first lower attachment lip 1552 and a second lower attachment lip 1562 that creates the corrugation.

As shown in this example, the first flange edge 1554 includes two grooves (although any suitable number of groove can be used) and along the entire length of both sides and the back of the first flange 1514. In this example, one of the grooves is disposed closer to the upper surface of first flange 1514 while the other groove is disposed closer to the lower surface of first flange 1514. Likewise, the second flange edge 1556 includes two grooves (although any suitable number of grooves can be used) along the entire length of both sides and the back of the second flange 1516. In this example, one of the grooves is disposed closer to the upper surface of second flange 1516 while the other groove is disposed closer to the lower surface of second flange 1516.

The first upper attachment lip 1550 and the first lower attachment lip 1552 align and attach the shroud 1502 to the middle flange 1514 and the lower flange 1516, respectively. In the example shown, the first upper attachment lip 1550 slides and aligns to a corrugation (e.g. a groove) of the first flange edge 1554. Further, the first lower attachment lip 1552 slides and aligns to a corrugation (e.g., a groove) of the second flange edge 1556.

Additionally, the second upper attachment lip 1560 and the second lower attachment lip 1562 also align (and attach) the shroud 1502 to the first flange 1514 and the second flange 1516. The complementary corrugation of the flanges 1514, 1516 with respect to the shrouding edges 1549, 1551 provide additional creepage distance between coil wire arrangements wound on the spool 1523 between the first flange 1514 and the second lower flange 1516, and coil wire arrangements wound on the upper or lower portion of the spool 1523. The additional creepage distance is provided along the surface of first and second flange edges 1554 and 1556.

Figure 15B:
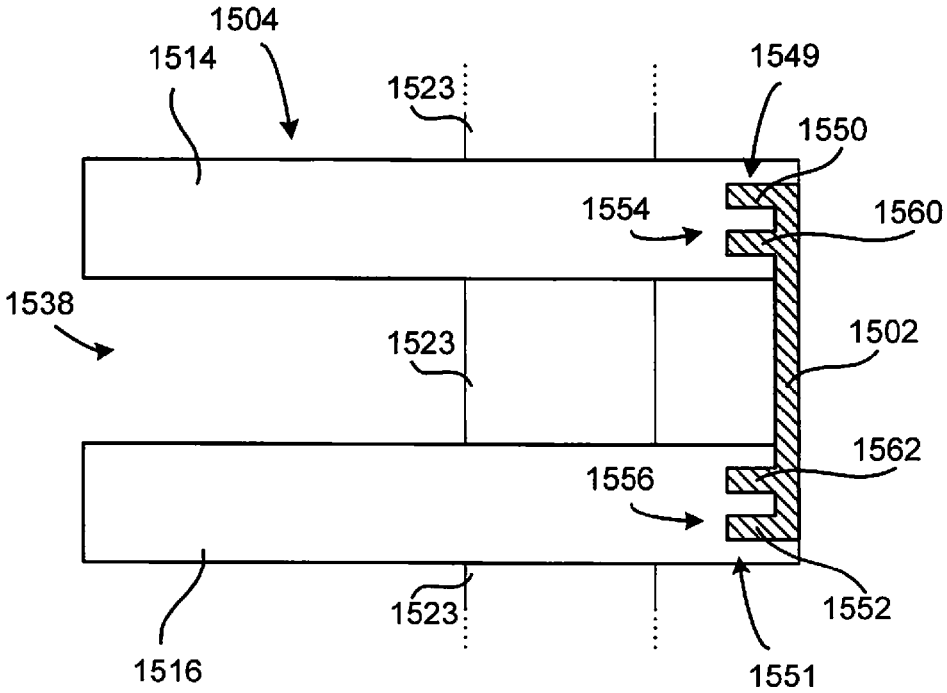
FIG. 15B is an example cross-section of the shroud and bobbin along line A-A of FIG. 15A.

Referring now to FIG. 15B, an example cross-section of the shroud 1502, the first flange 1514, the second flange 1516, the spool 1523, and the flange edges 1554 and 1556 along line A-A of FIG. 15A is depicted. As shown, the shroud 1502 includes a window 1538, the first shrouding edge 1549 and the second shrouding edge 1551.

The window 1538 allows access to coils of wire wound around spool 1523 at one end of the bobbin 1504. At the opposite end of the bobbin 1504, the shroud 1502 covers the coils of wire wound between the first flange 1514 and the second flange 1516. In addition, the first upper attachment lip 1550 attaches to a corrugation (e.g., groove) of the first flange edge 1554 while the first lower attachment lip 1352 attaches to a corrugation (e.g., groove) of the second flange edge 1556. Further, the second upper lip 1560 and the second lower lip 1562 slide into a respective corrugation (e.g., groove) of flange edges 1555, 1557. As shown in this example, the flange edges 1554 and 1556 are disposed along the entire width of one side of the first flange 1514 and the second flange 1516. In addition, attachment lips 1560 and 1562 are disposed on the entire width of the inner surface of shroud 1502.

Figure 16A:
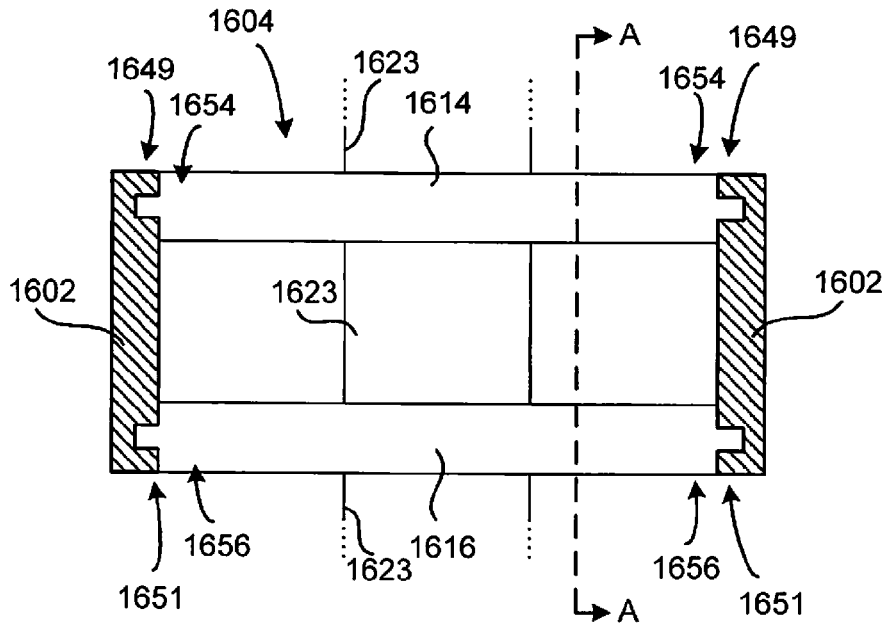
FIG. 16A is an example front view of an embodiment of a shroud coupled to the bobbin of FIG. 1A.

Referring now to FIG. 16A, an example front view of a shroud 1602 and a bobbin 1604 is depicted. The bobbin 1604 includes a first flange 1614 (e.g., middle flange), a second flange 1616 (e.g., lower flange), and a spool 1623. The first flange 1614 includes a first flange edge 1654 having a corrugation (e.g., a protrusion or two grooves) and the second flange edge 1616 includes a second flange edge 1656 having a corrugation (e.g., a protrusion or two grooves). In one example, the first flange edge 1654 and the second flange edge 1656 having the respective corrugation substantially circumscribe the first flange 1614 and the second flange 1616, respectively. In this example, the first flange edge 1654 and the second flange edge 1656 having the respective corrugation run along the sides and back of the respective flange 1614, 1616, but not the front. However, the respective corrugation may run along the front of the respective flange 1614, 1616.

The shroud 1602 includes a first shrouding edge 1649 and a second shrouding edge 1651. In one example, the first shrouding edge 1649 and the second shrouding edge 1651 substantially circumscribe the shroud 1602 (e.g., along both sides and the back of the shroud). The first shrouding edge 1649 includes a corrugation (e.g., a groove or two protrusions) that is complementary to the corrugation of the first flange edge 1654. The second shrouding edge 1651 includes a corrugation (e.g., a groove or two protrusions) that is complementary to the corrugation of the second flange edge 1656.

The first shrouding edge 1649 and the second shrouding edge 1651 align and attach the shroud 1602 onto the first flange 1614 and the second flange 1616, respectively. More specifically, in this example, a corrugation (e.g., protrusion) of the first flange edge 1654 slides into a complementary corrugation (e.g., groove) of the first shrouding edge 1649. Similarly, a corrugation (e.g., protrusion) of the second flange edge 1656 slides into a complementary corrugation (e.g., groove) of the second shrouding edge 1651. As such, the first flange edge 1654 substantially fills a corrugation of the first shrouding edge 1649 and vice versa. Likewise, the second flange edge 1656 substantially fills a corrugation of the second shrouding edge 1651 and vice versa.

The complementary corrugation of the flange edges 1654, 1656 with respect to the shrouding edges 1649, 1651 provide additional creepage distance between coil wire arrangements wound on the spool 1623 between the first flange 1614 and the second flange 1616, and coil wire arrangements wound on the upper or lower portion of the spool 1623. The additional creepage distance is provided along the surface of first and second flange edges 1654 and 1656. The size the number of corrugations can be selected to provide any suitable creepable distance. For example, in one embodiment, the size and number of corrugations can be selected to provide a creepage distance of at least 6.0 mm. Other creepage distances are contemplated.

Figure 16B:
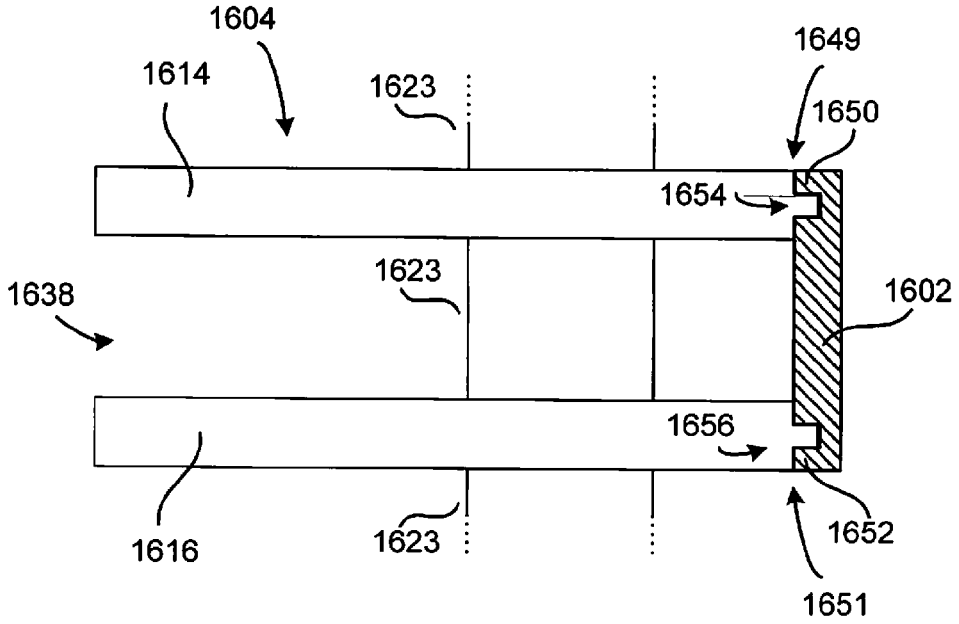
FIG. 16B is an example cross-section of the shroud and bobbin along line A-A of FIG. 16A.

Referring now to FIG. 16B, an example cross-section of the shroud 1602, the first flange 1614, the second flange 1616, the spool 1623, and the flange edges 1654, 1656 along line A-A of FIG. 16A is depicted. The example cross-section of the shroud 1602 further includes a window 1638, the first shrouding edge 1649, and the second shrouding edge 1651.

The window 1638 allows access to coils of wire wound around the spool 1623 at one end of the bobbin 1604. At the opposite end of the bobbin 1604, the shroud 1602 covers the coils of wire wound between the first flange 1614 and second flange 1616. In addition, as shown the shroud 1602 attaches flush with upper surface of first flange 1614 and flush with the lower surface of the second flange 1616. Further, as noted above, a corrugation (e.g., protrusion) of the first flange edge 1654 slides into a complementary corrugation (e.g., groove) of the first shrouding edge 1649. Similarly, a corrugation (e.g., protrusion) of the second flange edge 1656 slides into a complementary corrugation (e.g., groove) of the second shrouding edge 1651.

Figure 17A:
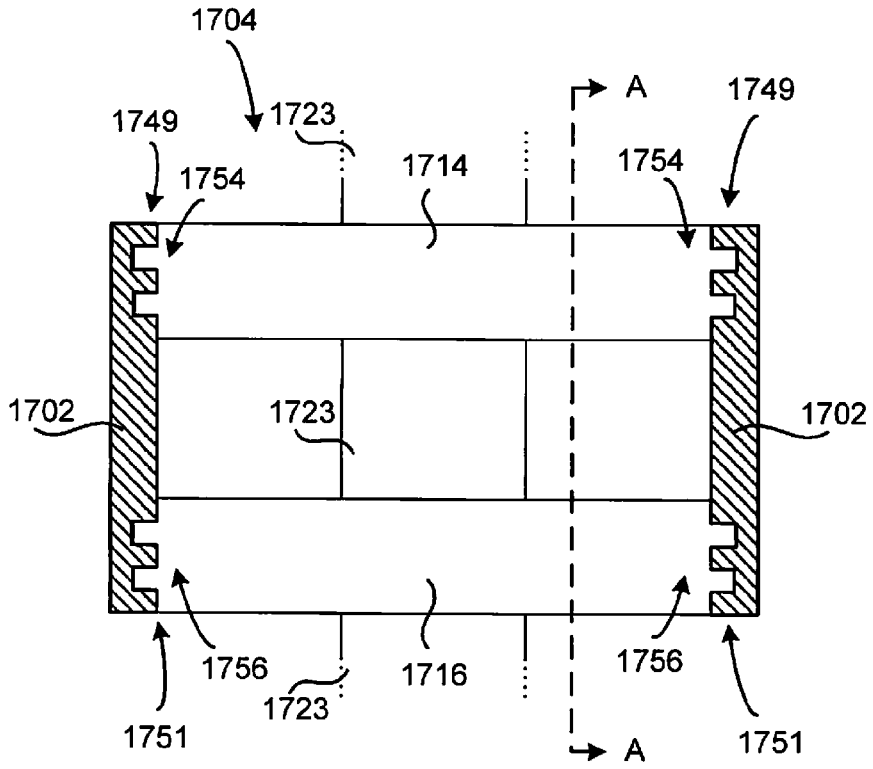
FIG. 17A is an example front view of an embodiment of a shroud coupled to the bobbin of FIG. 1A.

Referring now to FIG. 17A, an example front view of a shroud 1702 and a bobbin 1704 is depicted. The bobbin 1704 includes a first flange 1714 (e.g., a middle flange), a second flange 1716 (e.g., a lower flange), and a spool 1723. The first flange 1714 includes a first flange edge 1754 having a corrugation (e.g., two protrusions or three grooves) and the second flange 1716 includes a second flange edge 1756 having a corrugation (e.g., two protrusions or three grooves). In one example, the first flange edge 1754 and the second flange edge 1756 having the respective corrugation substantially circumscribe the first flange 1714 and the second flange 1716, respectively. In this example, the first flange edge 1754 and the second flange edge 1756 having the respective corrugation run along the sides and back of the respective flange 1714, 1716, but not the front. However, the respective corrugation may run along the front of the respective flange 1714, 1716.

The shroud 1702 includes a first shrouding edge 1749 and a second shrouding edge 1751. In one example, the first shrouding edge 1749 and the second shrouding edge 1751 substantially circumscribe the shroud 1702 (e.g., along both sides and the back of the shroud). The first shrouding edge 1749 includes a corrugation (e.g., two grooves or three protrusions) that is complementary to the corrugation of the first flange edge 1754. The second shrouding edge 1751 includes a corrugation (e.g., two grooves or three protrusions) that is complementary to the corrugation of the second flange edge 1756.

As shown in this example, the first flange edge 1754 includes two protrusions (although any suitable number of protrusions can be used) along the entire length of both sides and the back of the first flange 1714. In this example, one of the protrusions is disposed closer to the upper surface of first flange 1714 while the other protrusion is disposed closer to the lower surface of first flange 1714. Likewise, the second flange edge 1756 includes two protrusions (although any suitable number of protrusions can be used) along the entire length of both sides and the back of the second flange 1716. In this example, one of the protrusions is disposed closer to the upper surface of second flange 1716 while the other protrusion is disposed closer to the lower surface of second flange 1716.

The first shrouding edge 1749 and the second shrouding edge 1751 align and attach the shroud 1702 to the first flange 1714 and the second flange 1716, respectively. More specifically, in this example, a corrugation (e.g., two protrusions) of the first flange edge 1754 slides into a complementary corrugation (e.g., two grooves) of the first shrouding edge 1749. Similarly, a corrugation (e.g., two protrusions) of the second flange edge 1756 slides into a complementary corrugation (e.g., two grooves) of the second shrouding edge 1751. As such, the first flange edge 1754 substantially fills a corrugation of the first shrouding edge 1749 and vice versa. Likewise, the second flange edge 1756 substantially fills a corrugation of the second shrouding edge 1751 and vice versa.

The complementary corrugation of the flange edges 1754, 1756 with respect to the shrouding edges 1749, 1751 provide additional creepage distance between coil wire arrangements wound on the spool 1723 between the first flange 1714 and the second flange 1716, and coil wire arrangements wound on the upper or lower portion of the spool 1723. The additional creepage distance is provided along the surface of first and second flange edges 1754 and 1756. The size the number of corrugations can be selected to provide any suitable creepable distance. For example, in one embodiment, the size and number of corrugations can be selected to provide a creepage distance of at least 6.0 mm. Other creepage distances are contemplated.

Figure 17B:
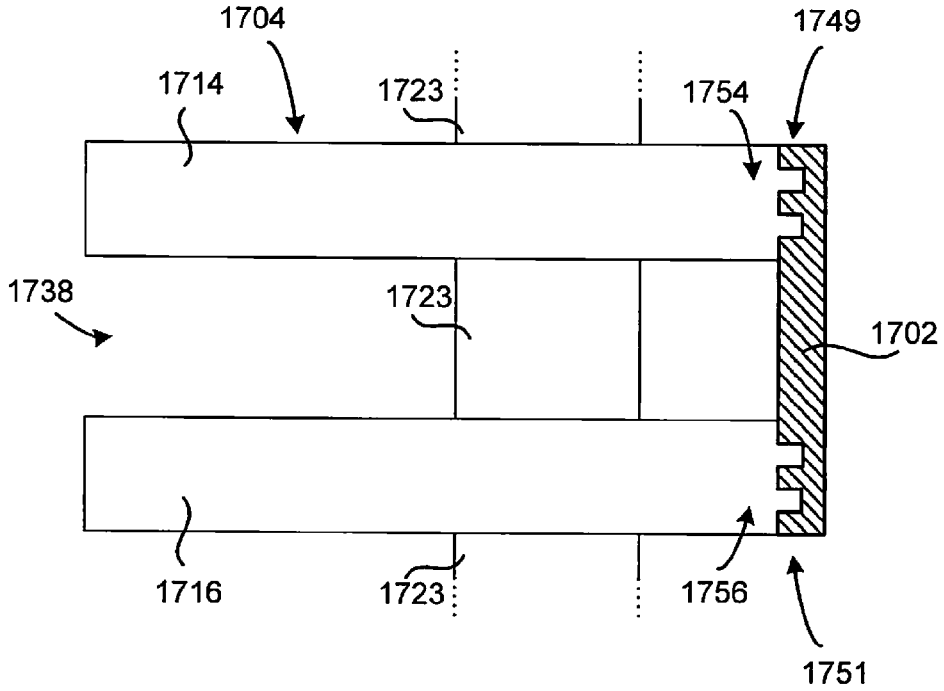
FIG. 17B is an example cross-section of the shroud and bobbin along line A-A of FIG. 17A.

Referring now to FIG. 17B, an example cross-section of the shroud 1702, the first flange 1714, the second flange 1716, the spool 1723, and flanges edges 1754, 1756 along line A-A of FIG. 16A is illustrated. As shown, the shroud 1702 includes a window 1738, the first shrouding edge 1749, and the second shrouding edge 1751.

The window 1738 allows access to coils of wire wrapped around spool 1723 at one end of the bobbin 1704. At the opposite end of the bobbin 1704, the shroud 1702 covers coils of wire wrapped between the first flange 1714 and the second flange 1716. In addition, the first shrouding edge 1749 attaches to the first flange edge 1754 and the second shrouding edge 1751 attaches to the second flange edge 1756. More specifically, in this example, a corrugation (e.g., two protrusions) of the first flange edge 1754 slides into a complementary corrugation (e.g., two grooves) of the first shrouding edge 1749. Similarly, a corrugation (e.g., two protrusions) of the second flange edge 1756 slides into a complementary corrugation (e.g., two grooves) of the second shrouding edge 1751. As such, the first flange edge 1754 substantially fills a corrugation of the first shrouding edge 1749 and vice versa. Likewise, the second flange edge 1756 substantially fills a corrugation of the second shrouding edge 1751 and vice versa.

Figure 18A:
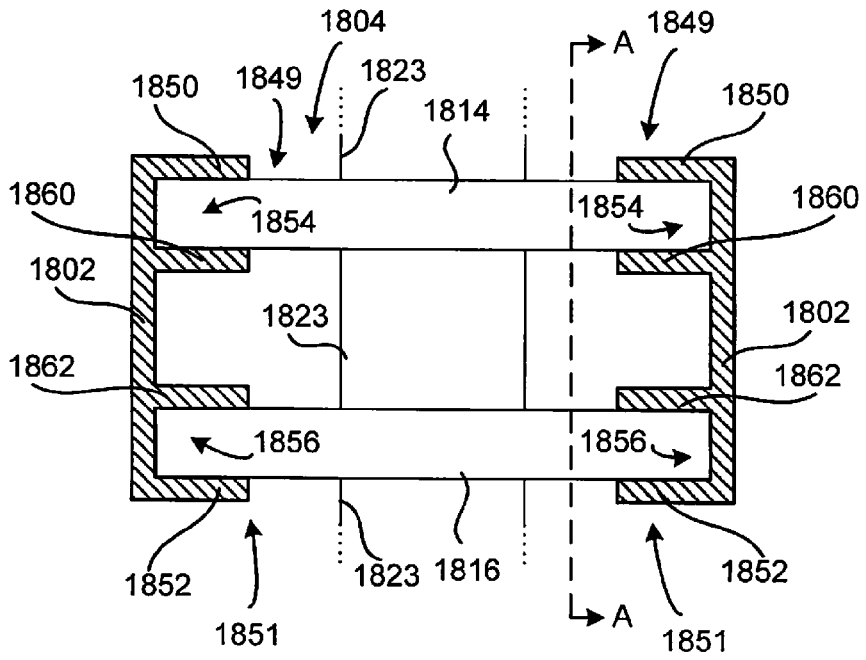
FIG. 18A is an example view of an embodiment of a shroud coupled to the bobbin of FIG. 1A.

Referring now to FIG. 18A, an example front view of a shroud 1802 and a bobbin 1804 is depicted. The bobbin 1804 includes a first flange 1814 (e.g., a middle flange), a second flange 1816 (e.g., a bottom flange), and a spool 1823. The first flange 1814 includes a first flange edge 1854 having a corrugation (e.g., a protrusion) and the second flange edge 1816 includes a second flange edge 1856 having a corrugation (e.g., a protrusion). In one example, the first flange edge 1854 and the second flange edge 1856 having the respective corrugation substantially circumscribe the first flange 1814 and the second flange 1816, respectively. In this example, the first flange edge 1854 and the second flange edge 1856 having the respective corrugation run along the sides and back of the respective flange 1814, 1816, but not the front. However, the respective corrugation may run along the front of the respective flange 1814, 1816.

The shroud 1802 includes a first shrouding edge 1849 and a second shrouding edge 1851. In one example, the first shrouding edge 1849 and the second shrouding edge 1851 substantially circumscribe the shroud 1802 (e.g., along both sides and the back of the shroud). The first shrouding edge 1849 includes a corrugation (e.g., a groove or two protrusions) that is complementary to the corrugation of the first flange edge 1854. More specifically, the first shrouding edge 1849 includes a first upper attachment lip 1850 and a second upper attachment lip 1860 that creates the corrugation. The second shrouding edge 1851 includes a corrugation (e.g., a groove or two protrusions) that is complementary to the corrugation of the second flange edge 1856. More specifically, the second shrouding edge 1851 includes a first lower attachment lip 1852 and a second lower attachment lip 1862 that creates the corrugation.

The first upper attachment lip 1850 and the first lower attachment lip 1852 align and attach the shroud 1802 to the first flange 1814 and the second flange 1816, respectively. In the example shown, the first upper attachment lip 1850 attaches to the upper surface of first flange 1814 and the first lower attachment lip 1852 attaches to the lower surface of the second flange 1816.

Additionally, the second upper attachment lip 1860 and the second lower attachment lip 1862 also align (and attach) the shroud 1802 to the first flange 1814 and the second flange 1816. The complementary corrugation of the flanges 1814, 1816 with respect to the shrouding edges 1849, 1851 provide additional creepage distance between coil wire arrangements wound on the spool 1823 between the first flange 1814 and the second lower flange 1816, and coil wire arrangements wound on the upper or lower portion of the spool 1823. The additional creepage distance is provided along the surface of first and second flange edges 1854 and 1856.

Figure 18B:
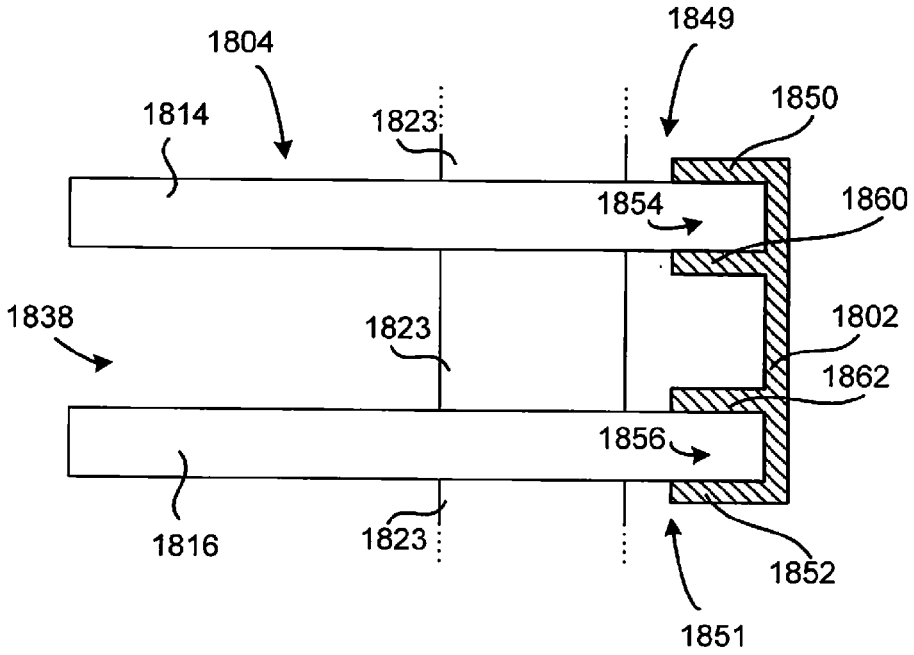
FIG. 18B is an example cross-section of the shroud and bobbin along line A-A of FIG. 18A.

Referring now to FIG. 18B, an example cross-section of the shroud 1802, the first flange 1814, the second flange 1816, the spool 1823, and the flanges edges 1854, 1856 along line A-A of FIG. 18A is depicted. As shown, the shroud 1802 includes a window 1838, the first shrouding edge 1849, and the second shrouding edge 1851.

The window 1838 allows access to coils of wire wound around spool 1823 at one end of the bobbin 1804. At the opposite end of the bobbin 1804, the shroud 1802 covers the coils of wire wound between the first flange 1814 and the second flange 1816. In addition, the first upper attachment lip 1850 attaches to upper surface of the first flange 1814 while the first lower attachment lip 1852 attaches to the lower surface of the second flange 1816. Further, the second upper attachment lip 1860 and the second lower attachment lip 1862 slide into a respective corrugation of the flange edges 1854 and 1856, respectively. As shown in this example, the flange edges 1854 and 1856 are disposed along the entire width of one side of the first flange 1814 and the second flange 1816. In addition, attachment lips 1860 and 1862 are disposed on the entire width of the inner surface of shroud 1802.

Although the disclosure is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

What is claimed is:

1. A transformer assembly comprising:

a vertical bobbin comprising:

a first winding wound around a first winding portion, a second winding wound around a second winding portion, and a flange, disposed between the first winding and the second winding, the flange comprising a flange edge;

a shrouding element, substantially covering one of: the first winding portion and the second winding portion, the shrouding element comprising a shrouding edge operatively coupled to the flange edge, wherein the flange edge and the shrouding edge have at least one complementary corrugation, the complementary corrugation increasing the creepage distance between the first winding and the second winding; and a base flange, operatively coupled to a single end of the vertical bobbin, wherein an axis of the vertical bobbin is substantially perpendicular to the base flange.

2. The transformer assembly of claim 1 wherein the shrouding element substantially contours to the vertical bobbin.

3. A transformer assembly comprising:

a vertical bobbin comprising:

a first winding wound around a first winding portion, a second winding wound around a second winding portion, and a flange, disposed between the first winding portion and the second winding portion, the flange comprising a flange edge having at least one groove;

a shrouding element, substantially covering one of: the first winding portion and the second winding portion, the shrouding element comprising a shrouding edge operatively coupled to the flange edge, the shrouding edge has at least one protrusion that complements the at least one groove of the flange edge; and a base flange, operatively coupled to a single end of the vertical bobbin, wherein an axis of the vertical bobbin is substantially perpendicular to the base flange.

4. The transformer assembly of claim 3 wherein the at least one protrusion substantially fills the at least one groove.

5. The transformer assembly of claim 3 wherein the flange edge comprises a plurality of grooves.

6. The transformer assembly of claim 5 wherein the shrouding edge comprises a plurality of protrusions that complement the plurality of grooves of the flange edge.

7. The transformer assembly of claim 3 wherein the shrouding element substantially contours to the vertical bobbin.

8. A resonant power converter comprising the transformer assembly of claim 3.

9. A transformer assembly comprising:

a vertical bobbin comprising:

a first winding wound around a first winding portion, a second winding wound around a second winding portion, and a flange, disposed between the first winding portion and the second winding portion, the flange comprising a flange edge;

a shrouding element, substantially covering one of: the first winding portion and the second winding portion, the shrouding element comprising a shrouding edge operatively coupled to the flange edge, wherein: the flange edge has at least one protrusion and the shrouding edge has at least one groove that complements the at least one protrusion of the flange edge; and a base flange, operatively coupled to a single end of the vertical bobbin, wherein an axis of the vertical bobbin is substantially perpendicular to the base flange.

10. The transformer assembly of claim 9 wherein the at least one protrusion substantially fills the at least one groove.

11. The transformer assembly of claim 9 wherein the flange edge comprises a plurality of protrusions.

12. The transformer assembly of claim 11 wherein the shrouding edge comprises a plurality of grooves that complement the plurality of protrusions of the flange edge.

13. The transformer assembly of claim 9 wherein the shrouding element substantially contours to the vertical bobbin.

14. A resonant power converter comprising the transformer assembly of claim 10.

15. The transformer assembly of claim 9 wherein:

the flange is a generally planar member having a periphery that includes the flange edge and a second flange edge disposed at a side of the periphery opposite from the flange edge and having at least one protrusion; and the shrouding member further comprises a second shrouding edge operatively coupled to the second flange edge, wherein the second shrouding edge has at least one groove that complements the at least one protrusion of the second flange edge, wherein the shrouding member defines a window dimensioned and disposed to allow access to the covered one of the first winding portion and the second winding portion.

16. The transformer assembly of claim 15 wherein:

the shrouding member further comprises:

a first shrouding member portion coupled to the shrouding edge and disposed to cover a first side of the one of the first winding portion and the second winding portion, a second shrouding member portion coupled to the second shrouding edge and disposed to cover a second side of the one of the first winding portion and the second winding portion, wherein the first side is opposite to the second side, and a third shrouding member portion disposed to join the first shrouding member portion and the second shrouding member portion to cover a third side of the one of the first winding portion and the second winding portion, wherein the window is disposed opposite the third shrouding member portion.

17. The transformer assembly of claim 1 wherein:

the flange is a generally planar member having a periphery that includes the flange edge and a second flange edge disposed at a side of the periphery opposite from the flange edge; and the shrouding member further comprises a second shrouding edge operatively coupled to the second flange edge, wherein the second flange edge and the second shrouding edge have at least one complementary corrugation, wherein the shrouding member defines a window dimensioned and disposed to allow access to the covered one of the first winding portion and the second winding portion.

18. The transformer assembly of claim 17 wherein:

the shrouding member further comprises:

a first shrouding member portion coupled to the shrouding edge and disposed to cover a first side of the one of the first winding portion and the second winding portion, a second shrouding member portion coupled to the second shrouding edge and disposed to cover a second side of the one of the first winding portion and the second winding portion, wherein the first side is opposite to the second side, and a third shrouding member portion disposed to join the first shrouding member portion and the second shrouding member portion to cover a third side of the one of the first winding portion and the second winding portion, wherein the window is disposed opposite the third shrouding member portion.

19. The transformer assembly of claim 3 wherein:

the flange is a generally planar member having a periphery that includes the flange edge and a second flange edge disposed at a side of the periphery opposite from the flange edge and having at least one groove; and the shrouding member further comprises a second shrouding edge operatively coupled to the second flange edge, wherein the second shrouding edge has at least one protrusion that is complementary to the at least one groove of the second flange edge, wherein the shrouding member defines a window dimensioned and disposed to allow access to the covered one of the first winding portion and the second winding portion.

20. The transformer assembly of claim 19 wherein:

the shrouding member further comprises:

a first shrouding member portion coupled to the shrouding edge and disposed to cover a first side of the one of the first winding portion and the second winding portion, a second shrouding member portion coupled to the second shrouding edge and disposed to cover a second side of the one of the first winding portion and the second winding portion, wherein the first side is opposite to the second side, and a third shrouding member portion disposed to join the first shrouding member portion and the second shrouding member portion to cover a third side of the one of the first winding portion and the second winding portion, wherein the window is disposed opposite to the third shrouding member portion.

* * * * *